US006103087A

United States Patent [19]

Mori

[11] Patent Number: 6,103,087

[45] Date of Patent: Aug. 15, 2000

[54] METHOD OF MANUFACTURING SUPPORT FOR PLANOGRAPHIC PRINTING PLATE AND PRESENSITIZED PLANOGRAPHIC PRINTING PLATE EMPLOYING THE SUPPORT

[75] Inventor: Takahiro Mori, Hino, Japan

[73] Assignee: Konica Corporation, Tokyo, Japan

[21] Appl. No.: 09/157,250

[22] Filed: Sep. 25, 1998

[30] Foreign Application Priority Data

Sep. 26, 1997 [JP] Japan ..... 9-261903

[51] Int. Cl.[7] ..... C25D 5/44; C25D 11/16; C25D 11/18

[52] U.S. Cl. ..... 205/214; 205/203

[58] Field of Search ..... 205/214, 201, 205/203

[56] References Cited

U.S. PATENT DOCUMENTS 5,759,743 6/1998 Muramoto et al. ..... 430/309

5,837,345 11/1998 Nishino et al. ..... 428/141

*Primary Examiner*—Kathryn Gorgos
*Assistant Examiner*—Edna Wong
*Attorney, Agent, or Firm*—Finnegan, Henderson, Farabow, Garrett & Dunner, L.L.P.

[57] ABSTRACT

Disclosed is a method for manufacturing a presensitized planographic printing plate comprising a support, and provided thereon, a light sensitive layer, the support having small pits with an average opening size of 0.2 to 0.8 $\mu$m and a depth to size ratio of 0.2 or less, and large pits, the method comprising the steps of (a) chemically, mechanically or electrolytically graining the surface of an aluminum or its alloy, (b) electrolytically surface roughening the resulting aluminum or alloy in an acidic electrolyte solution, (c) chemically surface roughening the electrolytically surface roughened aluminum or alloy, (d) anodizing the chemically surface roughened aluminum or alloy, and (e) providing a light sensitive layer on the anodized aluminum or alloy.

14 Claims, 3 Drawing Sheets

METHOD OF MANUFACTURING SUPPORT FOR PLANOGRAPHIC PRINTING PLATE AND PRESENSITIZED PLANOGRAPHIC PRINTING PLATE EMPLOYING THE SUPPORT

FIELD OF THE INVENTION

The present invention relates to a method of manufacturing a support for a planographic printing plate, and a presensitized planographic printing plate employing the support.

BACKGROUND OF THE INVENTION

Heretofore, there has been employed an electrolytic surface-roughening method as one of surface-roughening methods for a support of a planographic printing plate. However, when trying to obtain the surface roughness necessary for a support of a planographic printing plate only through electrolytic surface-roughening, the roughened surface has not been uniform sufficiently.

In the case of electrolysis of the support in an electrolytic solution mainly containing hydrochloric acid, in particular, too large pits exceeding 10 $\mu$m in terms of an opening size have tended to be generated, flat portions have remained unroughened without generation of relatively large pit having an opening size of 3–10 $\mu$m, and only an unevenly roughened surface has been obtained. In the case of electrolysis of the support in an electrolytic solution mainly containing nitric acid, on the other hand, too large pits exceeding 10 $\mu$m in terms of an opening size has hardly been generated, the distribution of the opening size has focused on a range of 1–3 $\mu$m, and generation of pits with an opening size of 1 $\mu$m or less has been only a little. Therefore, the resulting support tends to soil a blanket of a printing machine, though the roughened surface has been uniform.

To solve the problems mentioned above, there is employed a method wherein relatively large pits are formed through mechanical surface-roughening, while small pits with an opening size of about 1 $\mu$m are formed through electrolytic surface-roughening. However, pits or swells formed through the mechanical surface-roughening corresponds to pits having an opening size of about 10 $\mu$m, and it has been impossible to form a pit having an opening size ranging from about 3 $\mu$m to 6 $\mu$m. Further, Japanese Patent Examined Publication No. 98429/1995 discloses that generation of too large pits having an opening size of 10 $\mu$m or more can be eliminated by providing at least two standstills during electrolytic processing, in the case of the electrolytic surface-roughening. However, in the method disclosed by Japanese Patent Examined Publication No. 98429/1995, it is still impossible to obtain sufficient uniformity, and properties to minimize both dot gain at high fineness and ball-point pen damage have not been satisfactory. Anti-staining property of a blanket, anti-staining property at less dampening water supplying or printing property in employing printing paper (for example, YUPO paper) with poor ink absorption has not been satisfactory.

SUMMARY OF THE INVENTION

An object of the invention is to solve the above problems.

A first object of the invention is to provide a method of manufacturing a planographic printing plate support with uniform pits, minimizing too large pits, and having a depth to size (depth/size) ratio of small pits of 0.2 or less.

A second object of the invention is to provide a method of manufacturing a planographic printing plate support minimizing dot gain at high fineness, and improving anti-staining property of a blanket, anti-staining property at less dampening water supplying or printing property in employing printing paper (for example, YUPO paper) with poor ink absorption.

A third object of the invention is to provide a method of manufacturing a planographic printing plate support, the method comprising stably surface-roughening the support.

DETAILED DESCRIPTION OF THE INVENTION

Figure 1:
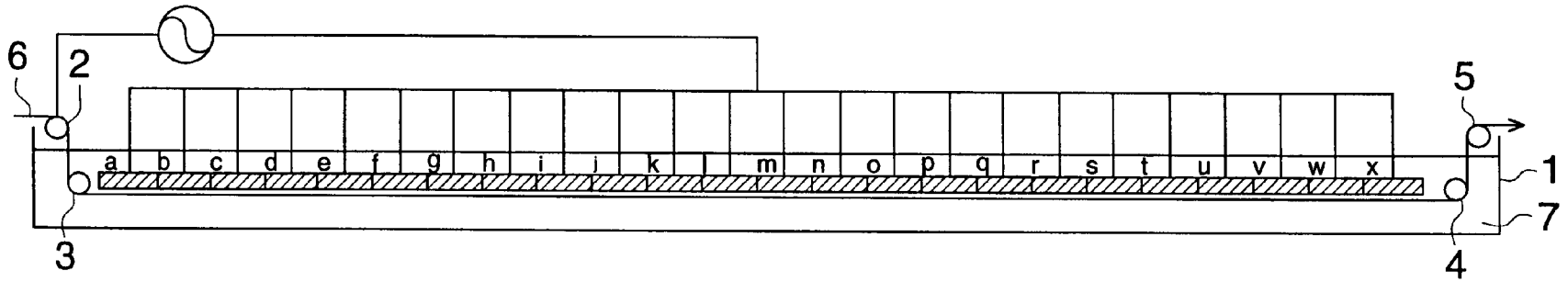
FIGS. 1, 2 and 3 are sectional views of an electrolytic apparatus for electrolytically surface roughening an aluminum or its alloy according to the invention.

The above objects of the invention can be attained by the followings:

1. a method for manufacturing a presensitized planographic printing plate comprising a support, and provided thereon, a light sensitive layer, the support having a dual-structure having large pits and small pits with an average opening size of 0.2 to 0.8 $\mu$m, and a depth to size ratio of small pits of 0.2 or less, the method comprising the steps of:
   (a) chemically, mechanically or electrolytically graining the surface of an aluminum or its alloy;
   (b) electrolytically surface roughening the resulting aluminum or alloy in an acidic electrolyte solution;
   (c) chemically surface roughening the electrolytically surface roughened aluminum or alloy;
   (d) anodizing the chemically surface roughened aluminum or alloy; and
   (e) providing a light sensitive layer on the resulting aluminum or alloy.

2. the method of item 1 above, wherein the large pits have an average opening size of 3 to 6 $\mu$m.

3. the method of item 1 above, wherein the step (a) comprises the steps of mechanically or electrolytically graining the surface of an aluminum or its alloy; and then chemically graining the mechanically or electrolytically grained aluminum or alloy by dissolving with an alkali 3.0 to 10.0 g/m$^2$ of the aluminum or alloy, and the step (c) comprises chemically surface roughening the electrolytically surface roughened aluminum or alloy by dissolving with an alkali 0.6 to 3.0 g/m$^2$ of the aluminum or alloy.

4. the method of item 1 above, wherein said acidic electrolyte solution contains hydrochloric acid and acetic acid.

5. the method of item 4 above, wherein said acidic electrolyte solution contains 7 to 15 g/liter of hydrochloric acid and 10 to 40 g/liter of acetic acid.

6. the method of item 1 above, the step (a) comprising the step of chemically graining the surface of an aluminum or its alloy, the step (c) comprising chemically surface roughening the electrolytically surface roughened aluminum or alloy by dissolving with an alkali 0.6 to 3.0 g/m$^2$ of the aluminum or alloy, and the electrolytically surface roughening step (b)

comprising plural pairs of first high processing rate steps and second low or zero processing rate steps, the first step and the second step being carried out alternately, wherein at least one of the first steps electrolytically surface roughens the chemically grained aluminum or alloy in an average quantity of electricity of 100 C/dm$^2$ or less.

7. the method of item 6 above, wherein said acidic electrolyte solution contains 7 to 15 g/liter of hydrochloric acid and 10 to 40 g/liter of acetic acid.

8. the method of item 6 above, wherein the low or zero processing rate step is carried out in 0.6 to 5 seconds.

9. the method of item 6 above, wherein neutralizing is conducted between steps (a) and (b) and between steps (c) and (d) employing an acid solution containing hydrochloride or acetic acid.

10. the method of item 1 above, wherein sealing treatment and/or hydrophilicity providing treatment is conducted between steps (d) and (e).

11. the method of item 1 above, wherein a light sensitive layer of the presensitized planographic printing plate has a dry thickness of 0.8 to 1.8 g/m$^2$ on the support.

12. the method of item 1 above, wherein the light sensitive layer contains an o-quinonediazide compound.

The present invention will be explained below.

The present invention is a method for manufacturing a presensitized planographic printing plate comprising a support, and provided thereon, a light sensitive layer, the support having a dual-structure having large pits and small pits with an average opening size of 0.2 to 0.8 $\mu$m, and a depth to size ratio of small pits of 0.2 or less, the method comprising the steps of:

(a) chemically, mechanically or electrolytically graining the surface of an aluminum or its alloy;

(b) electrolytically surface roughening the resulting aluminum or alloy in an acidic electrolyte solution;

(c) chemically surface roughening the electrolytically surface roughened aluminum or alloy;

(d) anodizing the chemically surface roughened aluminum or alloy; and (e) providing a light sensitive layer on the resulting aluminum or alloy.

An aluminum support used for the presensitized planographic printing plate in the invention includes a support made of pure aluminum and that made of aluminum alloy. As an aluminum alloy, there can be used various ones including an alloy of aluminum and each of metals such as, for example, silicon, copper, manganese, magnesium, chromium, zinc, lead, bismuth, nickel, titanium, sodium and iron. It is preferable that the surface of the aluminum support is subjected to degreasing treatment for removing rolling oil prior to graining. The degreasing treatment to be used includes degreasing treatment employing solvents such as trichlene and thinner, and an emulsion degreasing treatment employing an emulsion such as kerosene or triethanol. It is also possible to use an aqueous alkali solution containing an alkali agent such as caustic soda (sodium hydroxide) for the degreasing treatment. Such an aqueous alkali solution can remove soils and oxidized films on the support which can not be removed by the above-mentioned degreasing treatment alone. When the aluminum support is degreased employing the aqueous alkali solution, the dissolution amount of the aluminum is preferably 1.0 to 4.0 g/m$^2$. After the surface of the support is subjected to degreasing treatment employing the alkali solution, it is preferable to conduct neutralizing treatment by dipping in an acid such as phosphoric acid, nitric acid, hydrochloric acid, sulfuric acid and chromic acid, or in mixed acid thereof. When conducting electrolytical graining treatment after the neutralizing treatment, it is especially preferable that an acid used for the neutralizing is matched with that used for the electrolytical graining treatment.

The aluminum support surface, after degreased, is subjected to chemically, mechanically or electrolytically graining treatment, and can be subjected to two or more of the chemically, mechanically and electrolytically graining treatments.

For the chemically graining treatment, an aqueous alkali solution such as caustic soda is used in a similar manner as in the degreasing treatment. After the chemically graining treatment, it is preferable to conduct neutralizing treatment by dipping in an acid such as phosphoric acid, nitric acid, hydrochloric acid, sulfuric acid or in mixed acid thereof.

Though there is no restriction for the mechanically graining methods, brushing and honing are preferable. In the case of the brushing, graining is conducted by pressing on the surface of the aluminum support a cylindrical brush on which brush bristles each having a diameter of 0.2 mm–1 mm, for example, are flocked, while rotating the cylindrical brush and supplying slurry in which abrasives are dispersed in water between the cylindrical brush and the support. In the case of the honing, pressurized slurry in which abrasives are dispersed in water is jetted out of a nozzle in such a way as to hit obliquely the surface of a support so that it is grained. The abrasive includes those used generally for grinding such as volcanic ashes, alumina and silicon carbide, and a grain size of them is #200–#2000, while the preferable grain size is #400–#800.

It is preferable that the support whose surface has been mechanically grained is dipped in an acid or an aqueous alkali solution so that the surface of the support is etched, for the purpose of removing abrasives and aluminum dust which are embedded in the surface of the support and of controlling a shape of pits. The acid in this case includes, for example, sulfuric acid, persulfuric acid, hydrofluoric acid, phosphoric acid, nitric acid and hydrochloric acid, while, as an alkali, there may be given, for example, sodium hydroxide and potassium hydroxide. Among those mentioned above, an aqueous alkali solution is preferably used. After the aqueous alkali solution is used for etching, it is preferable to immerse in an acid such as phosphoric acid, nitric acid, sulfuric acid and chromic acid, or in a mixed acid thereof, for neutralizing treatment. When the neutralizing treatment is followed by electrolytically graining treatment, it is preferable that an acid used for the neutralizing is made to be matched with that used for the electrolytically graining treatment.

In the case of the electrolytically graining treatment, an alternating current is generally used in an acidic electrolytic solution for the graining.

The electrolytically graining treatment is preferably conducted under the same conditions as in electrolytically surface roughening treatment (electrolytically surface roughening in the invention) described later.

In the invention, the aluminum support surface, after subjected to chemically, mechanically or electrolytically graining treatment, is subjected to electrolytically surface roughening in the invention.

The electrolytically surface roughening in the invention is carried out in an acidic electrolytic solution supplying an electric current. With regard to a waveform of the power supply used for the electrolytically surface roughening in the invention, it is possible to use various waveforms such as a rectangular wave, a trapezoid wave, and a saw tooth wave, and a sine wave is especially preferable.

It is preferable that a voltage applied to the support in the electrolytically surface roughening in the invention is 1–50 V, and it is more preferable that the voltage is 5–30 V. For the current density (the largest value), a range of 10–200 $A/dm^2$ is preferable and a range of 20–150 $A/dm^2$ is more preferable. The total quantity of electricity through the electrolytically surface roughening is preferably 100–2000 $C/dm^2$, and more preferably 200–1000 $C/dm^2$. Temperature ranging from 10° C. to 50° C. is preferable, and a range of 15–45° C. is further preferable. The acidic electrolytic solution ail preferably contains hydrochloric acid and acetic acid. It is preferable that the hydrochloric acid content of the electrolytic solution is 7 to 15 g/liter, and the acetic acid content of the electrolytic solution is 10 to 40 g/liter. When necessary, it is possible to add, to the electrolytic solution, nitrates, chlorides, amines, aldehydes, phosphoric acid, chromic acid, boric acid, acetic acid or oxalic acid. It is preferable that the support, after the surface having been electrolytically roughened, is immersed in an acid or an aqueous alkali solution so that the surface of the support is etched, for the purpose of removing smuts on the surface of the support and of controlling a shape of pits. The acid in this case includes, for example, sulfuric acid, persulfuric acid, hydrofluoric acid, phosphoric acid, nitric acid and hydrochloric acid, while, as the base, there may be given, for example, sodium hydroxide and potassium hydroxide. Among those mentioned above, an aqueous alkali solution is preferably used. When the aqueous alkali solution is used for the etching, it is preferable to carry out neutralizing with an acid such as phosphoric acid, nitric acid, sulfuric acid or chromic acid, or in a mixed acid thereof. When conducting anodization treatment after the neutralizing processing, it is preferable that an acid used for the neutralizing is made to be matched with that used for the anodization.

In the invention, the aluminum support surface, after subjected to electrolytically surface roughening in the invention, is subjected to chemically surface roughening (chemically surface roughening in the invention). The chemically surface roughening in the invention is carried out to dissolve a given dissolution amount of aluminum. For the chemically surface roughening, an aqueous alkali solution containing an alkali agent such as caustic soda is used in a similar manner as in degreasing treatment. After chemically surface roughened with an alkali solution, neutralizing treatment is preferably carried out by immersing in an acid such as phosphoric acid, nitric acid, hydrochloric acid, sulfuric acid or in mixed acid thereof.

After the above surface-roughening processing, anodization treatment is carried out. There is no restriction in particular for the method of anodization treatment used in the invention, and known methods can be used. The anodization treatment forms an oxidized film on the surface of the support. For anodizing treatment in the invention, there is preferably used a method of applying a current density of 1–10 $A/dm^2$ to an aqueous solution containing sulfuric acid and/or phosphoric acid at concentration of 10–50%, as an electrolytic solution. However, it is also possible to use a method of applying a high current density to sulfuric acid as described in U.S. Pat. No. 1,412,768 and a method to electrically etching the support in phosphoric acid as described in U.S. Pat. No. 3,511,661.

The support which has been subjected to anodization treatment is optionally subjected to sealing treatment. For the sealing treatment, it is possible to use known methods using hot water, boiling water, steam, a sodium silicate solution, an aqueous dicromate solution, a nitrite solution and an ammonium acetate solution.

The small pits in the invention have an average opening size of 0.2 to 0.8 $\mu$m, and the depth to size ratio of the small pits is 0.2 or less.

The small pits with an average opening size exceeding 0.8 $\mu$m have a large pit volume, and requires a large amount of water necessary to cover the support surface, resulting in lowering anti-staining property at less dampening water supplying. The small pits with an average opening size less than 0.2 $\mu$m have too small pit volume to retain an effective amount of water on the support surface, resulting in lowering anti-staining property at non-image portions of a printing plate.

The depth to size ratio of the small pits is preferably 0.05 to 0.2, and more preferably 0.1 to 0.2.

In the invention, the large pits have an average opening size of preferably 3 to 6 $\mu$m.

In the invention, the average opening size of the large pits is one obtained by averaging opening sizes of the dual-structured pits having an opening size exceeding 2 $\mu$m and further having therein pits whose size is not more than 2 $\mu$m. The average opening size of the small pits is one obtained by averaging opening sizes of the pits having an opening size of not more than 2 $\mu$m and further having therein no smaller pits.

In the invention, the support having further large pits with an average opening size of 3 to 6 $\mu$m is preferable, and it provides a planographic printing plate support minimizing dot gain at high fineness.

In the invention is preferable a method for manufacturing a presensitized planographic printing plate comprising a support, and provided thereon, a light sensitive layer, the support having a dual-structure having large pits and small pits with an average opening size of 0.2 to 0.8 $\mu$m, and a depth to size ratio of small pits of 0.2 or less, the method comprising the steps of (a) mechanically or electrolytically graining the surface of an aluminum or its alloy, and then chemically graining the mechanically or electrolytically grained aluminum or alloy by dissolving with an alkali 3.0 to 10.0 $g/m^2$ of the aluminum or alloy, (b) electrolytically surface roughening the resulting aluminum or alloy in an acidic electrolyte solution, (c) chemically surface roughening the electrolytically surface roughened aluminum or alloy by dissolving with an alkali 0.6 to 3.0 $g/m^2$ of the aluminum or alloy, (d) anodizing the chemically surface roughened aluminum or alloy, and (e) providing a light sensitive layer on the anodized aluminum or alloy.

The acidic solution preferably contains hydrochloric acid and acetic acid.

The electrolytically graining or surface roughening is preferably carried out by electrolyzing an aluminum or its alloy in an aqueous acidic solution containing hydrochloric acid and acetic acid with alternating electric current.

In the invention is also preferable a method of manufacturing a presensitized planographic printing plate comprising a support, and provided thereon, a light sensitive layer, the support having a dual-structure having large pits and small pits with an average opening size of 0.2 to 0.8 $\mu$m, and a depth to size ratio of small pits of 0.2 or less, the method comprising the steps of (a) chemically graining the surface of an aluminum or its alloy, (b) electrolytically surface roughening the resulting aluminum or alloy in an acidic electrolyte solution, (c) chemically surface roughening the electrolytically surface roughened aluminum or alloy by dissolving with an alkali 0.6 to 3.0 g/m$^2$ of the aluminum or alloy, (d) anodizing the chemically surface roughened aluminum or alloy, and (e) providing a light sensitive layer on the anodized aluminum or alloy, the electrolytically surface roughening step (b) comprising plural pairs of first high processing rate steps and second low or zero processing rate steps, the first step and the second step being carried out alternately, wherein at least one of the first steps electrolytically surface roughens the chemically surface roughened aluminum or alloy in an average quantity of electricity of 100 C/dm$^2$ or less.

In the above method, neutralizing treatment is usually conducted between steps (a) and (b) and between steps (c) and (d) employing an acid solution, and the acid solution preferably contains hydrochloride or acetic acid.

In the above method, the low or zero processing rate step is carried out in preferably 0.6 to 5 seconds.

Figure 2:
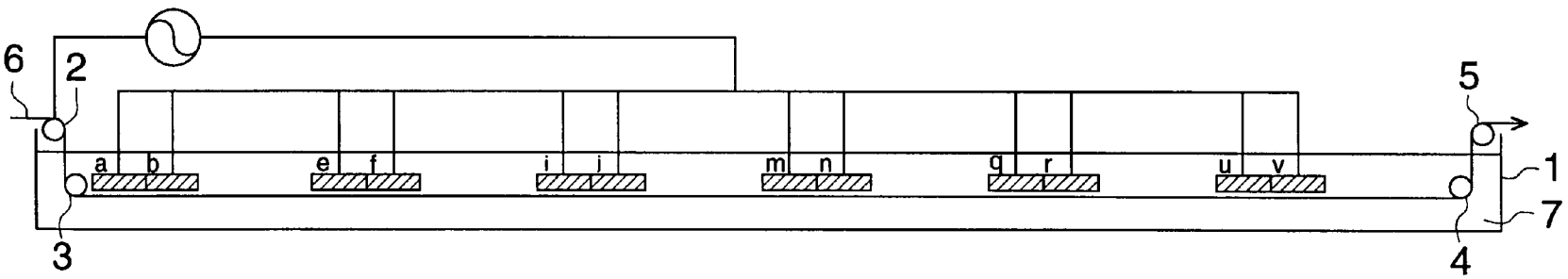

A way to have plural pairs of first high surface-roughening rate steps and second low or zero surface-roughening rate steps, the first step and the second step being carried out alternately, can be achieved by sporadically arranging electrodes as shown in FIG. 2 in an electrolytic apparatus shown in FIG. 1, for example. In FIG. 1, numeral 1 shows an electrolytic tank, which is charged with an electrolytic solution 7. The aluminum or its alloy web 6 is transported from the left side to the right side while supported by supporting rollers 2, 3, 4, and 5. Current is supplied between electrodes a through x and the web 6 from AC power source. FIG. 2 shows the same electrolytic tank as FIG. 1, except that electrodes c, d, g, h, k, l , o, p, s, t, w, and x of the 24 electrodes "a" through "x" are removed.

In this case, a portion of rapid electrolytic processing is a portion on a web facing an electrode, and a portion of slow or zero electrolytic processing is a portion on a web where no electrode exists. Even in the case of a portion of a web where no electrode exists, there is a location on the portion of a web through which a leakage current from a neighboring electrode flows, and electrolytic processing does not stop on that entire area. However, it is possible to obtain uniform grain by making an average quantity of electricity for electrolytic processing for one step in a rapid electrolytic processing to be 100 C/dm$^2$ or less.

In this case, the web faces electrodes at the high surface-roughening rate steps, and the web does not face electrodes at the low or zero surface-roughening rate steps. Even at the portion where the web does not face electrodes, there are portions to which a leakage current from a neighboring electrode flows, and electrolytic surface-roughening does not stop at the entire portion where the web does not face electrodes. However, it is possible to obtain a uniformly grained surface when the average quantity of electricity at one step of the high surface-roughening rate steps is 100 C/dm$^2$ or less.

Figure 3:
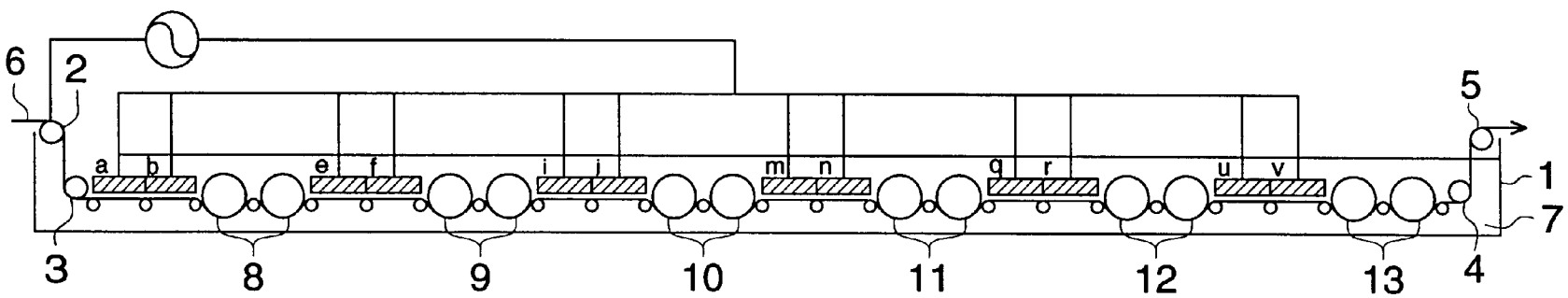

As shown in FIG. 3, current can be substantially shielded by placing rollers 8 through 13 in the portions where electrodes are not arranged. Even in another method, for example, in a method wherein there are provided electrolytic tanks in quantity identical to the number of times of surface-roughening, and electrolytic surface-roughening comes to a standstill at the cross-over section between the adjoining electrolytic tanks, the same effect as in the foregoing can naturally be obtained if the average quantity of electricity in one step of the high surface-roughening rate steps (in the electrolytic tanks) is 100 C/dm$^2$ or less. Due to this method, generation of too large pits is inhibited and a uniformly roughened surface can be obtained accordingly.

In the manufacturing method mentioned above, it is preferable that the time taken at the low or zero surface-roughening rate steps is 0.6 to 5 seconds. When the time required mentioned above is not less than 0.6 sec, an average opening size of large pits is uniform to be within a range of 3–6 $\mu$m, which makes it possible to obtain a roughened surface having no flat portion that is caused by the maldistribution of large pits. Though the same effect can be obtained even when the above-mentioned time is made longer, the period of standstill which is longer than 5 sec may extremely lower the productivity. Therefore, the time required of 5 sec or less is preferable.

When electrolytically surface roughening is carried out in an electrolyte solution of a batch type by varying current density to be supplied to comprise plural pairs of first high surface-roughening rate steps and second low or zero surface-roughening rate steps, the first step and the second step being carried out alternately, and an average quantity of electricity of 100 C/dm$^2$ or less being applied per one of the first steps, generation of too large pits is inhibited, and a uniformly roughened surface can be obtained.

The current density at the second low or zero surface-roughening rate steps is within a range of 0–10 A/dm$^2$, and preferably within a range of 0–2 A/dm$^2$.

The support surface treated as above is preferably subjected to hydrophilicity providing treatment. As the hydrophilicity providing treatment, for example, a hydrophilic subbing layer is preferably provided on the support. The hydrophilic subbing layer can contain an alkali metal silicate disclosed in U.S. Pat. No. 3,181,461, a hydrophilic cellulose disclosed in U.S. Pat. No. 1,860,426, an amino acid or its salt disclosed in Japanese Patent O.P.I. Publication Nos. 60-149491 and 63-165183, amines having a hydroxy group or their salts disclosed in Japanese Patent O.P.I. Publication No. 60-232998, phosphate disclosed in Japanese Patent O.P.I. Publication No. 62-19494 and high polymer compounds including a monomer unit having a sulfo group disclosed in Japanese Patent O.P.I. Publication No. 59-101651.

A light sensitive layer is coated on the above obtained support.

A light sensitive composition is coated on the support described above to form a light sensitive layer on the support.

Next, the light sensitive composition used for the light sensitive layer in the invention will be explained.

The light sensitive composition used in the invention is not specifically limited, and in the invention, a conventional light sensitive composition used in a presensitized planographic printing plate can be used. The light sensitive composition used in the invention is as follows:

1) Photo-crosslinkable Light Sensitive Resin Composition

The light sensitive component in a photo-crosslinkable light sensitive resin composition includes a light sensitive resin having an unsaturated double bond in the molecule, for example, a light sensitive resin having —CH═CH (C═O)— as a light sensitive group in its main chain, or polyvinyl cinnamate having a light sensitive group in its side chain disclosed in U.S. Pat. Nos. 3,030,208, 3,435,237 and 3,622,208.

2) Photo-polymerizable Light Sensitive Resin Composition

The photo-polymerizable light sensitive resin composition contains an addition-polymerizable unsaturated compound. The composition is composed of a monomer having a double bond or a mixture of a monomer having a double bond and a polymer, and the example thereof includes those disclosed in U.S. Pat. Nos. 2.760,863 and 2,791,504.

The photo-polymerizable composition includes a composition containing methylmethacrylate, a composition containing methylmethacrylate and polymethylmethacrylate, a composition containing methylmethacrylate, polymethylmethacrylate and a polyethylene glycol methacrylate monomer, and a composition containing methylmethacrylate, an alkyd resin and a polyethylene glycol dimethacrylate monomer.

The photo-polymerizable light sensitive resin composition contains a photopolymerization initiator well known in the art such as a benzoin derivative such as benzoin, a benzophenone derivative such as benzophenone, a thioxanthone derivative, an anthraquinone derivative, or an acridone derivative.

3) Light Sensitive Composition Containing Diazo Compound

The preferred diazo compound used in the light sensitive composition is a diazo resin obtained by condensation of an aromatic diazonium salt with formaldehyde or acetoaldehyde. Especially preferable is a salt of a condensation product of p-diazophenylamine with formaldehyde or acetoaldehyde, for example, a diazo resin inorganic salt such as a hexafluorophosphate, tetrafluoroborate, perchlorate or periodate salt of the condensation product, or a diazo resin organic salt such as a sulfonate salt of the condensation product disclosed in U.S. Pat. No. 3,300,309.

It is preferable that the diazo resin be used in combination with a binder. As such a binder, various high molecular compounds are available. Of these resins, preferred ones include copolymers between a monomer having an aromatic hydroxyl group such as N-(4-hydroxyphenyl)acrylamide, N-(4-hydroxyphenyl)methacrylamide, o-, m- or p-hydroxystyrene or o-, m- or p-hydroxyphenyl methacrylate and another monomer, as disclosed in Japanese Pat. O.P.I. Pub. No. 98613/1979; polymers containing hydroxyethyl acrylate units or hydroxyethyl methacrylate units as the repetitive unit, as disclosed in U.S. Pat. No. 4,123,276; natural resins such as shellac and rosin; polyvinyl alcohols; polyamide resins disclosed in U.S. Pat. No. 3,751,257; linear polyurethane resins disclosed in U.S. Pat. No. 3,660,097; phthalated polyvinyl alcohol resins; epoxy resins obtained from bisphenol A and epichlorohydrin; and cellulosic resins such as cellulose acetate and cellulose acetate phthalate.

4) Light Sensitive Composition Containing o-Quinonediazide Compound

The o-quinonediazide compound is a compound having an o-quinonediazide group in the molecule. The o-quinonediazide compound used in the invention includes an o-naphthoquinonediazide compound such as an ester compound of o-naphthoquinonediazide sulfonic acid and a polycondensate resin of phenols with aldehydes or ketones.

Examples of the phenols used in the polycondensate resin of phenols with aldehydes or ketones include a monohydric phenol such as phenol, o-cresol, m-cresol, p-cresol, 3,5-xylenol, carvacrol and thymol, a dihydric phenol such as catechol, resorcin or hydroquinone, and a trihydric phenol such as pyrogallol or phloroglucin. Examples of the aldehydes include formaldehyde, benzaldehyde, acetaldehyde, crotonaldehyde and furfural. Preferred are formaldehyde and benzaldehyde. Examples of the ketones include acetone, and methyl ethyl ketone.

The examples of the polycondensate resin of phenols with aldehydes or ketones include a phenol-formaldehyde resin, a m-cresol-formaldehyde resin, a mixed m- and p-cresol-formaldehyde resin, a resorcin-benzaldehyde resin, and a pyrogallol-acetone resin.

In the o-naphthoquinonediazide compound, the condensation ratio of the o-naphthoquinonediazide sulfonic acid to the hydroxyl group of the phenol component is 15 to 80 mol %, and preferably 20 to 45 mol %.

The o-quinonediazide compound used in the invention include those disclosed in Japanese Patent O.P.I. Publication No. 58-43451. The examples thereof include conventional 1,2-quinonediazide compounds such as 1,2-benzoquinonediazide-sulfonate, 1,2-benzoquinonediazidesulfonamide, 1,2-naphthoquinonediazide-sulfonate and 1,2-naphthoquinonediazide-sulfonamide and, further, include 1,2-quinonediazide compounds such as 1,2-benzoquinonediazide-4-sulfonic acid phenyl ester, 1,2,1',2'-di-(benzoquinonediazide-4-sulfonyl)dihydroxybiphenyl, 1,2-benzoquinonediazide-4-(N-ethyl-N-β-naphthyl) sulfonamide, 1,2-naphthoquinonediazide-5-sulfonic acid cyclohexyl ester, 1-(1,2-naphthoquinonediazide-5-sulfonyl)-3,5-dimethylpyrazole, 1,2-naphthoquinonediazide-5-sulfonic acid-4'-hydroxydiphenyl-4'-β-naphthol ester, N,N-di-(1,2-naphthoquinonediazide-5-sulfonyl)-aniline, 2'-(1,2-naphthoquinonediazide-5-sulfonyloxy)-1-hydroxyanthraquinone, 1,2-naphthoquinonediazide-5-sulfonic acid-2,4-dibydroxybenzophenone ester, 1,2-naphthoquinonediazide-5-sulfonic acid-2,3,4-trihydroxybenzophenone ester, a condensation product of 2 moles of 1,2-naphthoquinonediazide-5-sulfonic acid chloride with 1 mole of 4,4'-diaminobenzophenone, a condensation product of 2 moles of 1,2-naphthoquinonediazide-5-sulfonic acid chloride with 1 mole of 4,4'-dihydroxy-1,1'-diphenylsulfone, a condensation product between 1 mole of 1,2-naphthoquinonediazide-5-sulfonic acid chloride and 1 mole of purpurogallin, and 1,2-naphthoquinonediazide-5-(N-dihydroabietyl)-sulfonamide described in J. Kosar, Light-Sensitive Systems, John Wily & Sons, New York, pp. 339–352 (1965) and W. S. De Forest, Photoresist, Vol. 50, McGraw-Hill, New York (1975). Other examples are 1,2-naphthoquinonediazide compounds described in Japanese Pat. Exam. Pub. Nos. 37-1953, 37-3627, 37/13109, 40/26126, 40/3801, 45/5604, 45/27345 and 51/13013, and Japanese Pat. O.P.I. Pub. Nos. 48/96575, 48/63802 and 48/63803.

Among the above described o-quinonediazide compounds is especially preferable an o-quinonediazide ester compound obtained by reacting 1,2-benzoquinonediazide sulfonylchloride or 1,2-naphthoquinonediazide sulfonylchloride with a pyrogallol-acetone resin or 2,3,4-trihydroxybenzophenone.

In the invention, the o-quinonediazide compound may be used singly or in combination.

The o-quinonediazide compound content of the light sensitive layer is preferably 5 to 60% by weight, and more preferably 10 to 50% by weight.

The light sensitive composition containing the o-quinonediazide compound can further contain a clathrate compound.

Among the clathrate compounds, cyclic or acyclic D-glucans, cyclophanes or acyclic cyclopahane analogs are preferable. Further concretely, cyclodextrins, resorcinol-aldehyde cyclic oligomers or para-substituted phenol alicyclic oligomer are preferable.

The still more preferable includes cyclodextrins or derivatives thereof, and the most preferable includes β-cyclodextrins or derivatives thereof.

The content of the clathrate compound in the light sensitive composition is preferably 0.01 to 10% by weight, and more preferably 0.1 to 5% by weight.

The light sensitive composition containing an o-quinonediazide compound preferably contains an alkali soluble resin. The alkali soluble resin used with the o-quinonediazide compound includes a novolak resin, a vinyl polymer having a phenolic hydroxy group, and a polycondensate of polyhydric phenol with aldehyde or ketone disclosed in Japanese Patent O.P.I. Publication No. 55-57841.

The above novolak resin includes a phenol-formaldehyde resin, a cresol-formaldehyde resin, a phenol-cresol-formaldehyde resin disclosed in Japanese Patent O.P.I. Publication No. 55-57841, and a copolycondensate of a p-substituted phenol, and phenol or cresol with formaldehyde disclosed in Japanese Patent O.P.I. Publication No. 55-127553.

The novolak resin has a number average molecular weight (Mn) of preferably $3.00\times10^2$ to $7.50\times10^3$, more preferably $5.00\times10^2$ to $4.00\times10^3$, and a weight average molecular weight (Mw) of preferably $1.00\times10^3$ to $3.00\times10^4$, more preferably $3.00\times10^3$ to $2.00\times10^4$, in terms of polystyrene standard.

The above novolak resin may be used singly or in combination.

When the novolak resin is used, the novolak resin content of the light sensitive layer is preferably 5 to 95% by weight.

The vinyl polymer having a phenolic hydroxy group herein referred to implies a polymer having a group with the phenolic hydroxy group in the polymer molecule structure, and preferably has a structural unit represented by the following formulas (I) through (V):

formula (I)

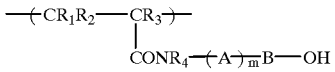

formula (II)

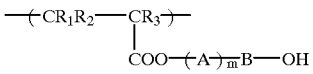

formula (III)

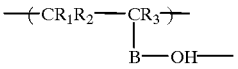

formula (IV)

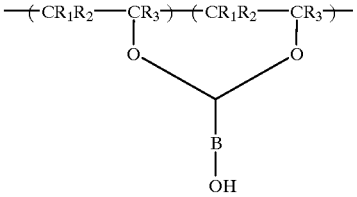

formula (V)

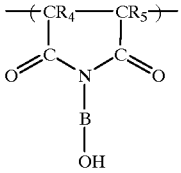

In formulas (I) through (V), $R_1$ and $R_2$ independently represent a hydrogen atom, an alkyl group or a carboxy group, and preferably represent hydrogen atoms; $R_3$ represents a hydrogen atom, a halogen atom or an alkyl group, and preferably represent a hydrogen atom or an alkyl group such as methyl or ethyl; $R_4$ and $R_5$ independently represent a hydrogen atom, an alkyl group, an aryl group or an aralkyl group, and preferably represent hydrogen atoms; A represents a substituted or unsubstituted alkylene group combining the aromatic carbon atom with the nitrogen or oxygen atom; m represents an integer of 0 to 10; and B represents a substituted or unsubstituted phenyl group or a substituted or unsubstituted naphthyl group.

The vinyl polymer used in the invention having the above phenolic hydroxy group is preferably a copolymer having the structures represented by formulas (I) through (V) above. The monomer used for copolymerization includes an ethylenically unsaturated olefin such as ethylene, propylene, isobutylene, butadiene or isoprene; styrene such as styrene, α-methylstyrene, p-methylstyrene or p-chloromethystyrene; acrylic acid such as acrylic acid or methacrylic acid; an unsaturated aliphatic dicarboxylic acid such as itaconic acid, maleic acid or maleic anhydride; an α-methylene aliphatic monocarboxylic acid ester such as methylacrylate, ethylacrylate, n-butylacrylate, isobutylacrylate, dodecylacrylate, 2-chloroethylacrylate, phenylacrylate, α-chloromethylacrylate, methylmethacrylate, ethylmethacrylate or ethylethacrylate, ethylacrylate; a nitrile such as acrylonitrile or methacrylonitrile; an amide such as acryl amide; an anilide such as m-nitroacrylanilide or m-methoxyacrylanilide; a vinyl ester such as vinyl acetate, vinyl propionate or vinyl benzoate; vinyl ether such as methylvinyl ether, ethylvinyl ether, isobutylvinyl ether or β-chloroethylvinyl ether; vinyl chloride; vinylidene chloride; vinylidene cyanide; an ethylene derivative such as 1-methyl-1-methoxyethylene, 1,1-dimethoxyethylene, 1,2-dimethoxyethylene, 1,1i-dimethoxycarbonylethylene or 1-methyl-1-nitroxyethylene; and an N-vinyl monomer such as N-vinylindole, N-vinylpyrrolidine, or N-vinylpyrrolidone. These monomers are present in the copolymer in the cleavage form of the double bond.

Among the above monomers, the aliphatic monocarboxylic acid ester or nitrile is preferable, in that it exhibits the superior performance of the invention. The monomers may be contained in the copolymer at random or in the form of block.

When the vinyl polymer containing a phenolic hydroxy group is used, the polymer is contained in the light sensitive layer in an amount of preferably 0.5 to 70% by weight.

The vinyl polymer containing a phenolic hydroxy group may be used singly or in combination. The vinyl polymer may be used in combination with another polymer.

When the alkali soluble polymer is used, an o-quinonediazide compound content of the light sensitive layer is preferably 5 to 60% by weight, and more preferably 10 to 50% by weight.

5) As the light sensitive composition used in the invention, a light sensitive composition is also used which comprises a compound capable of generating an acid on exposure of an actinic light, a compound having a chemical bond capable of being decomposed by an acid or a compound having a group cross-linking by an acid, an infrared absorber, and optionally a binder. The compound capable of generating an acid on exposure of an actinic light, the compound having a chemical bond capable of being decomposed by an acid or the compound having a group cross-linking by an acid, the infrared absorber, and the binder will be explained below.

(Compound capable of generating an acid on irradiation of an active light)

The compound (hereinafter referred to as the acid generating compound in the invention) capable of generating an acid on irradiation of an active light used in the light sensitive composition of the invention includes various conventional compounds and mixtures. For example, a salt of diazonium, phosphonium, sulfonium or iodonium ion with $BF_4^{31}$ , $PF_6^-$, $SbF_6^-$ $SiF_6^{2-}$ or $ClO_4^-$, an organic halogen containing compound, o-quinonediazide sulfonylchloride or a mixture of an organic metal and an organic halogen containing compound is a compound capable of generating or releasing an acid on irradiation of an active light, and can be used as the acid generating compound in the invention. The organic halogen containing compound known as an photoinitiator capable of forming a free radical forms a hydrogen halide and can be used as the acid generating compound of the invention.

The examples of the organic halogen containing compound capable of forming a hydrogen halide include those disclosed in U.S. Pat. Nos. 3,515,552, 3,536,489 and 3,779,778 and West German Patent No. 2,243,621, and compounds generating an acid by photodegradation disclosed in West German Patent No. 2,610,842. The examples of the acid generating compounds used in the invention include o-naphthoquinone diazide-4-sulfonylhalogenides disclosed in Japanese Patent O.P.I. Publication No. 50-30209.

The preferable acid generating compound in the invention is an organic halogen containing compound in view of sensitivity to infrared rays and storage stability of an image forming material using it. The organic halogen containing compound is preferably a halogenated alkyl-containing triazines or a halogenated alkyl-containing oxadiazoles. of these, halogenated alkyl-containing s-triazines are especially preferable. The examples of the halogenated alkyl-containing oxadiazoles include a 2-halomethyl-1,3,4-oxadiazole compound disclosed in Japanese Patent O.P.I. Publication Nos. 54-74728, 55-24113, 55-77742/1980, 60-3626 and 60-138539. The preferable examples of the 2-halomethyl-1,3,4-oxadiazole compound are listed below.

A

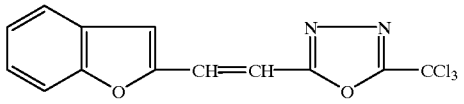

B

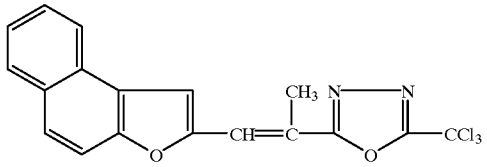

C

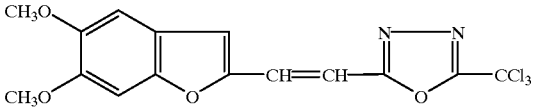

The halogenated alkyl containing triazines are preferably a compound represented by the following formula (1):

formula (1)

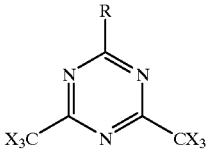

wherein R represents an alkyl group, a halogenated alkyl, an alkoxy group, a substituted or unsubstituted styryl group, or a substituted or unsubstituted aryl group; (for example, phenyl or naphthyl group) and $X_3$ represents a halogen atom.

The examples of an s-triazine acid generating compound represented by formula (1) are listed below.

(1)

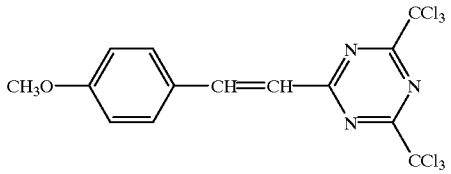

(2)

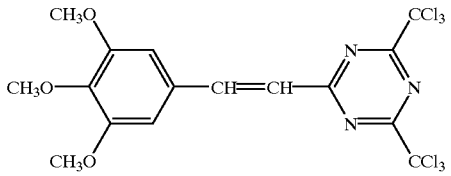

(3)

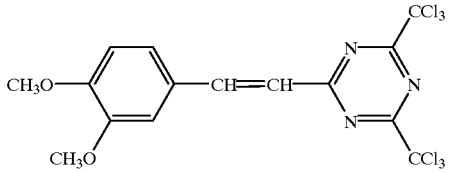

(4)

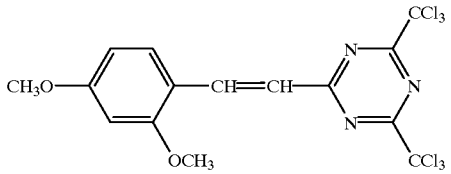

(5)

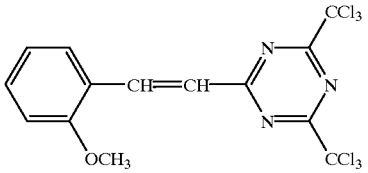

(6)

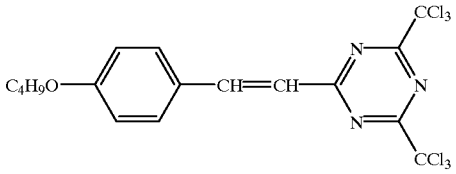

(7)

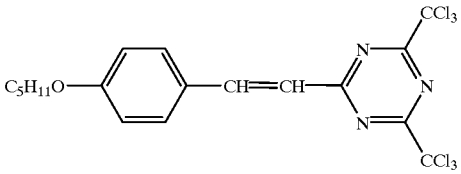

(8)

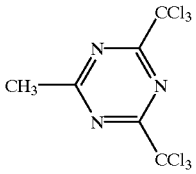

-continued (9)

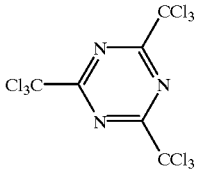

(10)

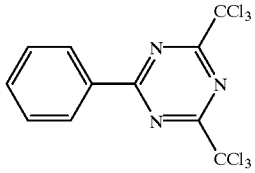

(11)

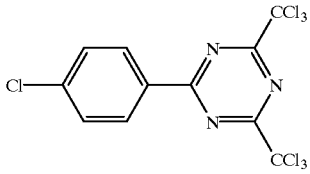

(12)

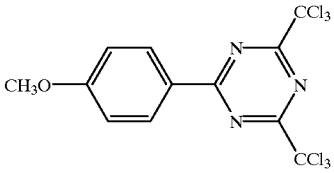

(13)

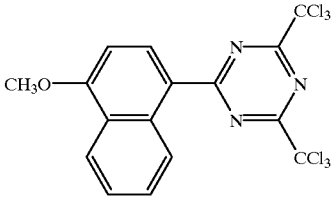

(14)

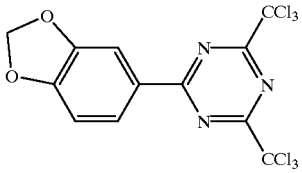

The content of the acid generating compound in the light sensitive composition is preferably 0.1 to 20% by weight, and more preferably 0.2 to 10% by weight based on the total weight of the solid components of the composition, although the content broadly varies depending on its chemical properties, kinds of light sensitive composition used or physical properties of the composition.

(Compound having a chemical bond capable of being decomposed by an acid)

The compound (hereinafter referred to also as the acid decomposable compound in the invention) having a chemical bond capable of being decomposed by an acid used in the invention includes a compound having a C—O—C bond disclosed in Japanese Patent O.P.I. Publication Nos. 48-89003/1973, 51-120714/1976, 53-133429/1978, 55-12995/1980, 55-126236/1980 and 56-17345/1981, a compound having an Si—O—C bond disclosed in Japanese Patent O.P.I. Publication Nos. 60-37549/1985 and 60-121446/1985, another acid decomposable compound disclosed in Japanese Patent O.P.I. Publication Nos. 60-3625/1985 and 60-10247/1985, a compound having an Si—N bond disclosed in Japanese Patent O.P.I. Publication No. 62-222246/1987, a carbonic acid ester disclosed in Japanese Patent O.P.I. Publication No. 62-251743/1987, an orthocarbonic acid ester disclosed in Japanese Patent O.P.I. Publication No. 62-2094561/1987, an orthotitanic acid ester disclosed in Japanese Patent O.P.I. Publication No. 62-280841/1987, an orthosilicic acid ester disclosed in Japanese Patent O.P.I. Publication No. 62-280842/1987, an acetal or ketal disclosed in Japanese Patent O.P.I. Publication No. 63-10153/1988 and a compound having a C-S bond disclosed in Japanese Patent O.P.I. Publication No. 62-244038/1987.

Of these compounds, the compound having a C—O—C bond, the compound having an Si—O—C bond, the orthocarbonic acid esters, the acetals or ketals or the silylethers disclosed in Japanese Patent O.P.I. Publication Nos. 53-133429/1978, 56-17345/1981, 60-121446/1985, 60-37549/1985, 62-209451/1987 and 63-10153/1988 are preferable. Of these compounds is especially preferable a polymer disclosed in Japanese Patent O.P.I. Publication No. 53-133429/1978 which has a repeated acetal or ketal group in the main chain and increasing solubility in a developer by action of an acid or a compound capable of being decomposed by an acid disclosed in Japanese Patent O.P.I. Publication No. 63-10153/1988, which has the following structure:

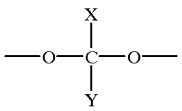

Wherein X represents a hydrogen atom or

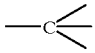

Y represents

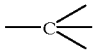

provided that X and Y may be the same or different.

The examples of the acid decomposable compound used in the invention include compounds disclosed in the above described patent specifications and their synthetic method is described in the above described patent specifications.

As the acid decomposable compound in the invention are preferable orthocarbonic acid esters, acetals, ketals or silylethers, each compound having a $—(CH_2CH_2O)_n—$ group in which n is an integer of 1 to 5, in view of sensitivity and developability. Of the compounds having a $—(CH_2CH_2O)_n—$ group, n is especially preferably 1 to 4. The typical example of such a compound includes a condensation product of dimethoxycyclohexane, benzaldehyde or their derivative with diethylene glycol, triethylene glycol, tetraethylene glycol or pentaethylene glycol.

In the invention, the compound represented by the following formula (2) or (2') is preferable as the acid decomposable compound in view of sensitivity and developability.

formula (2)

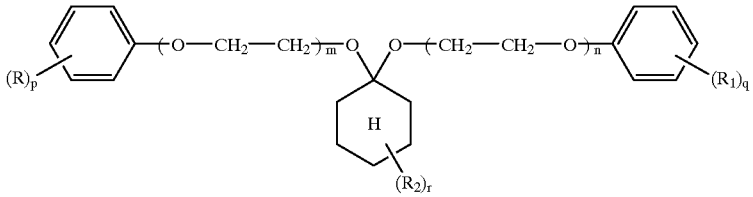

formula (2')

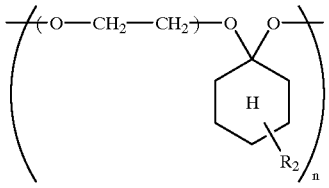

wherein R, $R_1$ and $R_2$ independently represent a hydrogen atom, an alkyl group having 1 to 5 carbon atoms, an alkoxy group having 1 to 5 carbon atoms, a sulfo group, a carboxyl group or a hydroxy group, p, q and r independently represent an integer of 1 to 3, and m and n independently represent an integer of 1 to 5. The alkyl group represented by R, $R_1$ and $R_2$ may be straight chained or branched, and includes a methyl group, an ethyl group, a propyl group, an isopropyl group, a butyl group, a tert-butyl group, and a pentyl group. The alkoxy group represented by R, $R_1$ and $R_2$ includes a methoxy group, an ethoxy group, a propoxy group, an isopropoxy group, a butoxy group, a tert-butoxy group, and a pentoxy group. In the compound represented by formula (2), m and n each especially preferably are 1 to 4. The compound represented by formula (2) or (2') can be prepared according to a conventional synthetic method.

The content of the acid decomposable compound in the light sensitive composition of the invention is preferably 5 to 70% by weight, and more preferably 10 to 50% by weight based on the total solid weight of the light sensitive composition. The acid decomposable compound in the invention can be used singly or in combination.

(Compound having a group cross-linking by an acid)

In the invention, the compound having a group cross-linking by an acid herein referred to is a compound (hereinafter referred to also as a cross-linking agent) cross-linking alkali soluble resins in the presence of an acid. The cross-linking agent cross-links the alkali soluble resin and lowers solubility in the alkali of the cross-linked alkali soluble resin. The alkali solubility lowering extent in the invention is such that the cross-linked alkali soluble resin is insoluble in the alkali. Concretely, when the light sensitive material is imagewise exposed which comprising a light sensitive layer containing the alkali soluble resin and the cross-linking agent on a support, the alkali soluble resin at exposed portions is cross-linked so that the cross-linked resin is insoluble in an alkali solution as a developer, in which the alkali soluble resin before exposure has been soluble in the developer, and the exposed material is developed with the developer to remain the exposed portions on the support. The cross-linking agent includes a compound having a methylol group or a methylol derivative group, a melamine resin, a furan resin, an isocyanate, and a blocked isocyanate (an isocyanate having a protective group). The cross-linking agent is preferably a compound having a methylol group or an acetoxymethyl group. The content of the cross-linking agent is preferably 1 to 80% by weight, and more preferably 5 to 60% by weight based on the total solid weight of the light sensitive composition of the invention.

(Infrared absorber)

The infrared absorber used in the invention includes an infrared absorbing dye having an absorption in the wavelength range of 700 nm or more, carbon black and magnetic powder. The especially preferable infrared absorber has an absorption maximum in the wavelength range of 700 nm to 850 nm and having a molar extinction coefficient, $\epsilon$ of $10^5$ or more.

The above infrared absorber includes cyanine dyes, squarylium dyes, chloconium dyes, azulenium dyes, phthalocyanine dyes, naphthalocyanine dyes, polymethine dyes, naphthoquinone dyes, thiopyrilium dyes, dithiol metal complex dyes, anthraquinone dyes, indoaniline metal complex dyes and intermolecular charge transfer complex dyes. The above described infrared absorber includes compounds disclosed in Japanese Patent O.P.I. Publication Nos. 63-139191/1988, 64-33547/1989, 1-160683/1989, 1-280750/1989, 1-293342/1989, 2-2074/1990, 3-26593/1991, 3-30991/1991, 3-34891/1991, 3-36093/1991, 3-36094/1991, 3-36095/1991, 3-42281/1991 and 3-103476/1991.

In the invention, the infrared absorber is especially preferably a cyanine dye represented by the following formula (3) or (4):

formula (3)

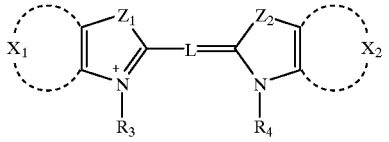

formula (4)

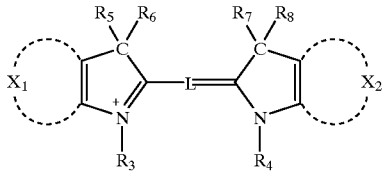

wherein $Z_1$ and $Z_2$ independently represent a sulfur atom, a selenium atom or an oxygen atom; $X_1$ and $X_2$ independently represent a non-metallic atomic group necessary to form a benzene or naphthalene ring, which may have a substituent; $R_3$ and $R_4$ independently represent a substituent, provided that one of $R_3$ and $R_4$ represents an anionic group, $R_5$, $R_6$, $R_7$ and $R_8$ independently represent a hydrogen atom, a halogen atom or an alkyl group having 1 to 3 carbon atoms; and L represents a linkage with a conjugated bond having 5 to 13 carbon atoms.

The cyanine dye represented by formula (3) or (4) includes a cyanine dye in which formula (3) or (4) itself forms a cation in its intramolecule and has an anionic group as a counter ion. The anionic group includes $Cl^-$, $Br^-$, $ClO_4^-$, $BF_4^-$, and an alkyl borate anion such as a t-butyltriphenyl borate anion.

The carbon number (n) in the linkage with a conjugated bond represented by L of formula (3) or (4) is preferably selected to match with wavelength of light emitted from an infrared laser used for exposure as a light source. For example, when a YAG laser, which emits 1060 nm light, is used, n is preferably 9 to 13. The conjugated bond may have a substituent, and may form a ring together with another atomic group. The substituent of the ring represented by $X_1$ or $X_2$ may be any, but is preferably a group selected from the group consisting of a halogen atom, an alkyl group having 1 to 5 carbon atoms, an alkoxy group having 1 to 5 carbon atoms, —$SO_3M$, and —COOM (in which M represents a hydrogen atom or an alkali metal atom). The substituent of $R_3$ and $R_4$ may be any, but is preferably an alkyl group having 1 to 5 carbon atoms, an alkoxy group having 1 to 5 carbon atoms, or —$((CH_2)n—O—)_k—(CH_2)_mOR$ (in which n and m independently represent an integer of 1 to 3, k represents 0 or 1, and R represents an alkyl group having 1 to 5 carbon atoms), or preferably one of $R_3$ and $R_4$ represents —$RSO_3M$, and the other —$RSO_3^-$, in which R represents an alkylene group having 1 to 5 carbon atoms, and M represents an alkali metal atom, or preferably one of $R_3$ and $R_4$ represents —RCOOM, and the other —$RCOO^-$, in which R represents an alkylene group having 1 to 5 carbon atoms, and M represents an alkali metal atom. It is more preferable in view of sensitivity or developability that one of $R_3$ and $R_4$ represents —$RSO_3M$ or —RCOOM as described above, and the other —$RSO_3^-$ or —$RCOO^-$ as described above.

When a semiconductor laser is used for exposure as a light source, a dye represented by formula (3) or (4) is preferably a dye having an absorption peak in the range of 750 to 900 nm and a molar extinction coefficient $\epsilon$ exceeding $1\times10^5$, and when a YAG laser is used for exposure as a light source, a dye represented by formula (3) or (4) is preferably a dye having an absorption peak in the range of 900 to 1200 nm and a molar extinction coefficient $\epsilon$ exceeding $1\times10^5$.

The examples of the infrared absorber preferably used in the invention are listed below, but are not limited thereto.

IR1

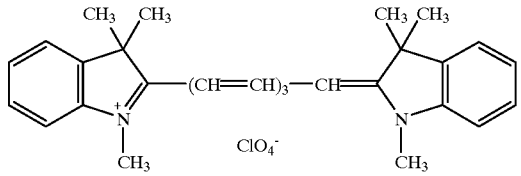

IR2

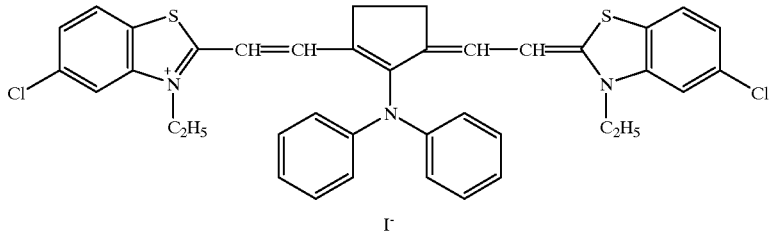

IR3

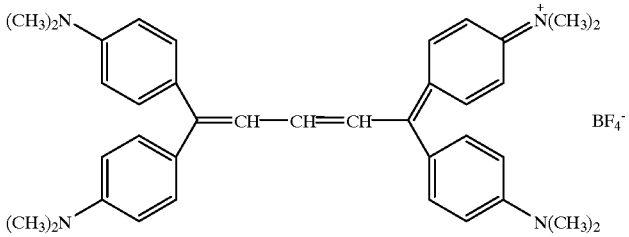

IR4

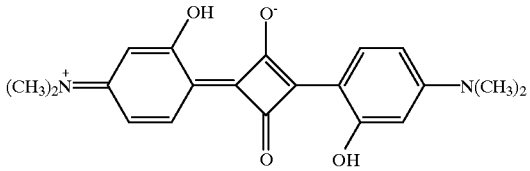

IR5

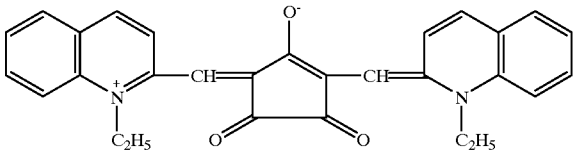

IR6

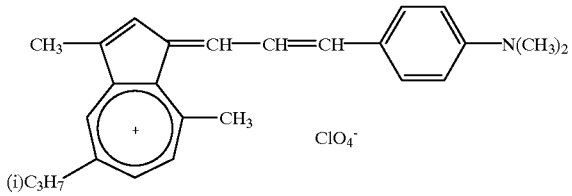

-continued
IR7
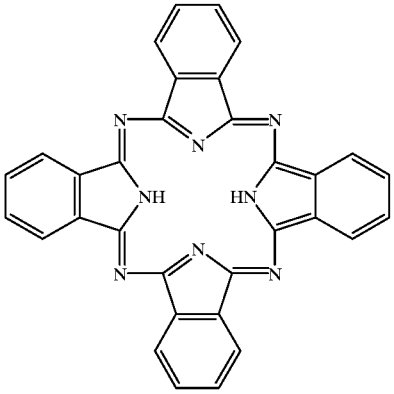
IR8
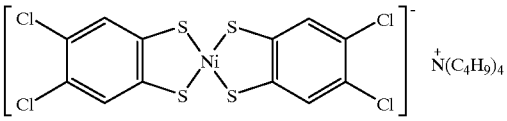
IR9
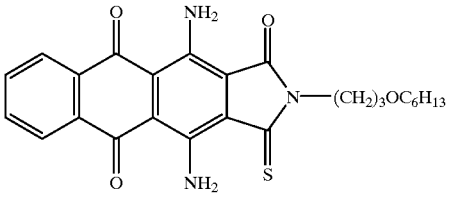
IR10
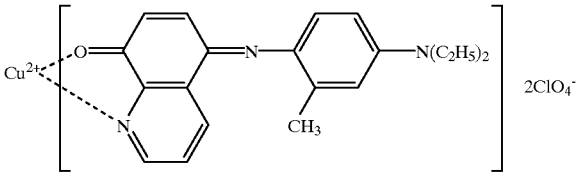
IR11
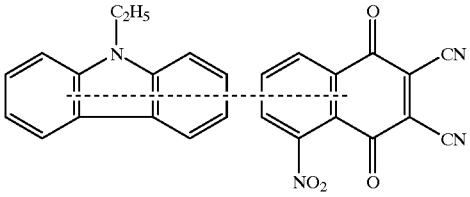
IR12
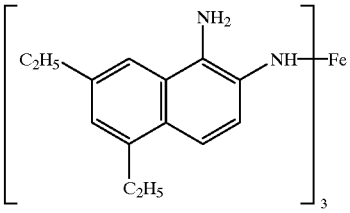

-continued
IR13
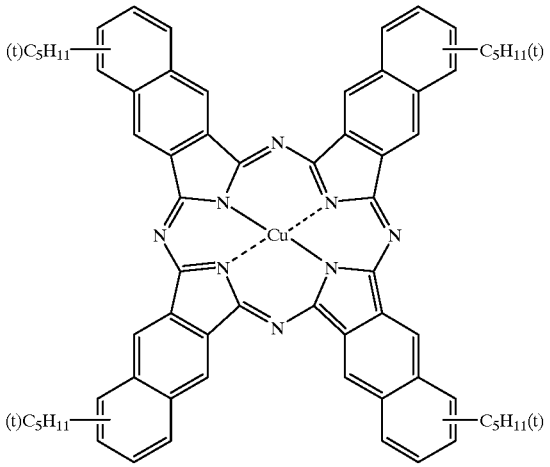
IR14
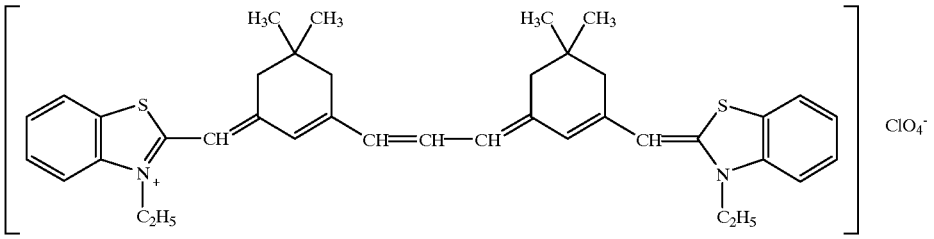
IR15
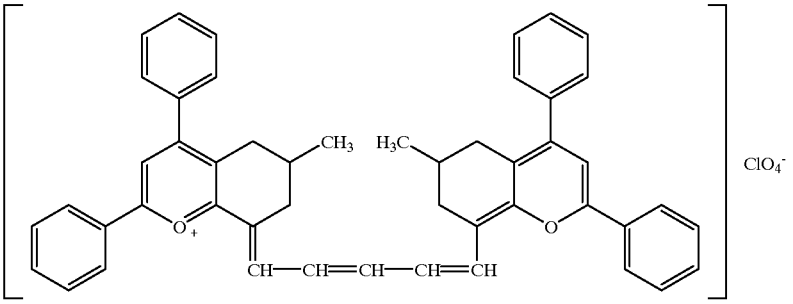
IR16
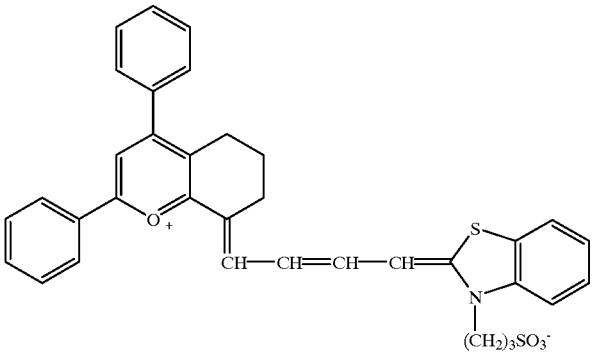

-continued
IR17
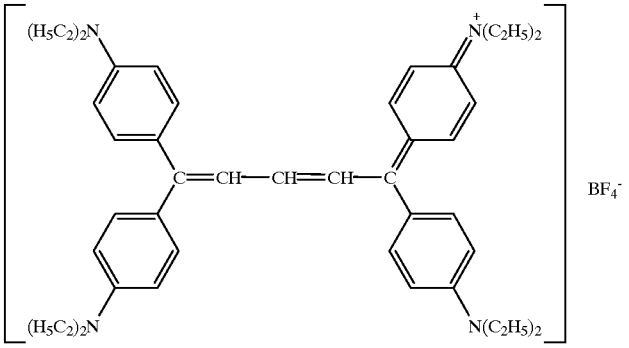
IR18
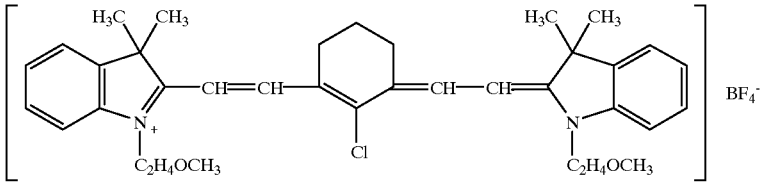
IR19
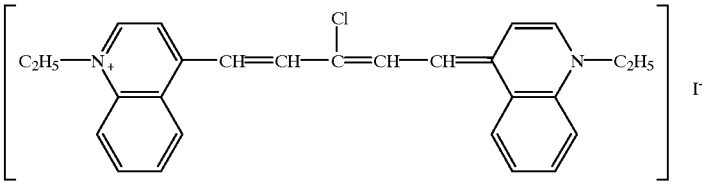
IR20
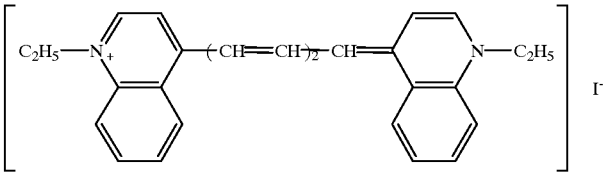
IR21
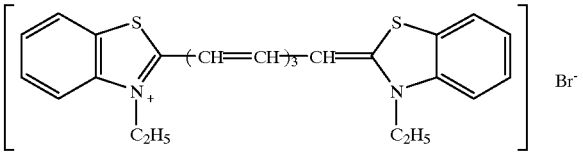
IR22
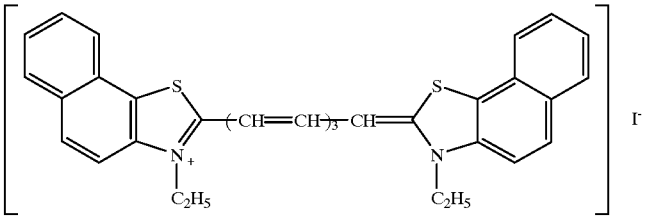
IR23
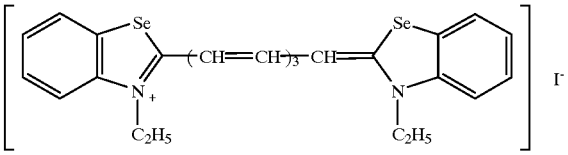

-continued
IR24
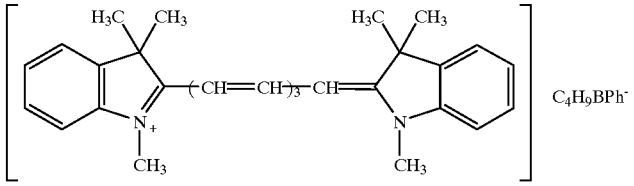
IR25
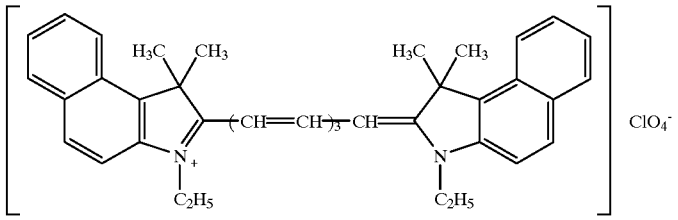
IR26
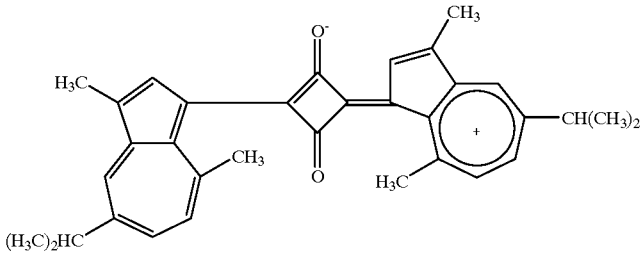
IR27
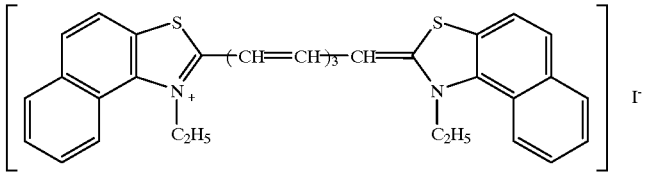
IR28
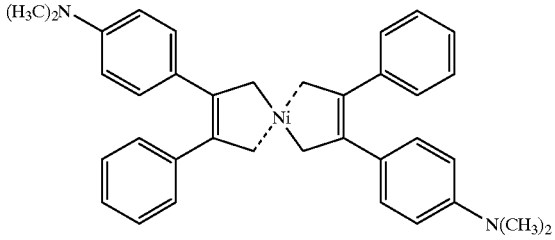
IR29
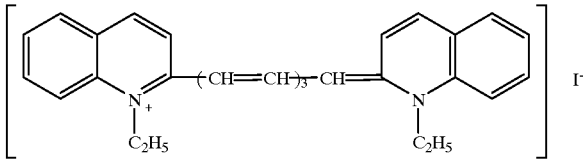
IR30
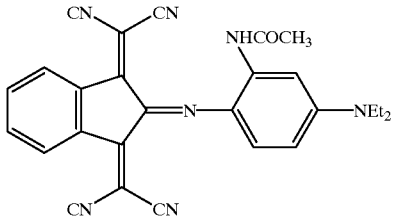

-continued
IR31
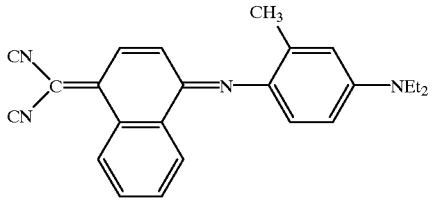
IR32
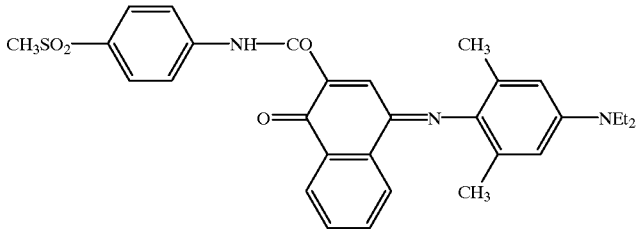
IR33
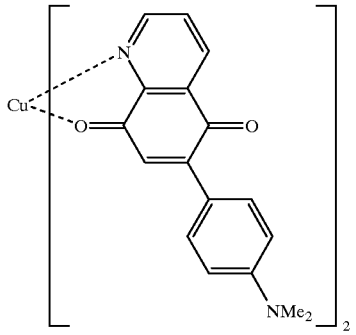
IR34
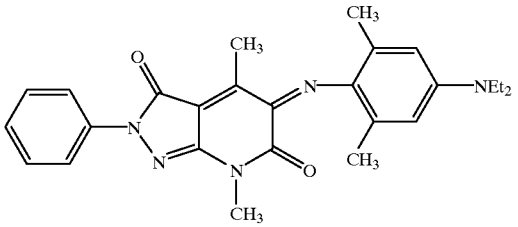
IR35
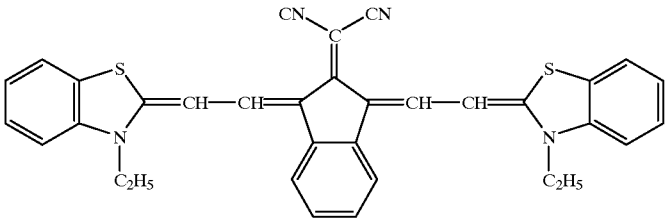
IR36
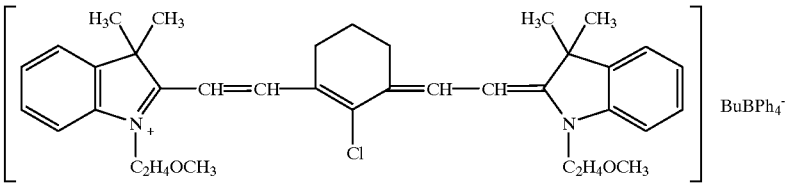

-continued
IR37
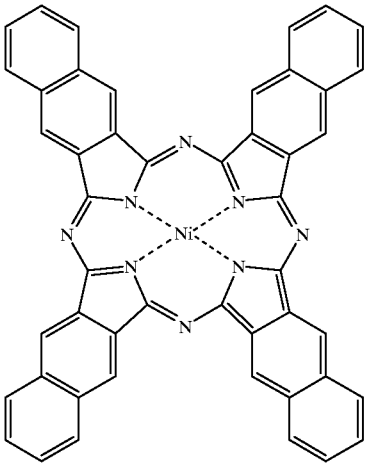
IR38
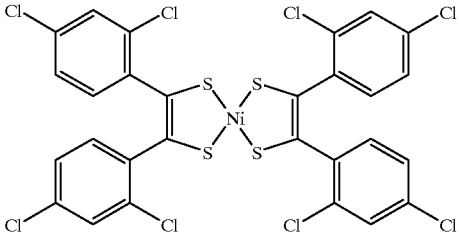
IR39
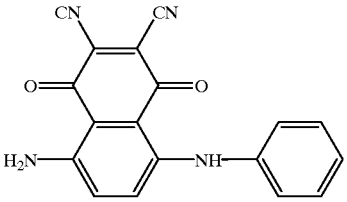
IR40
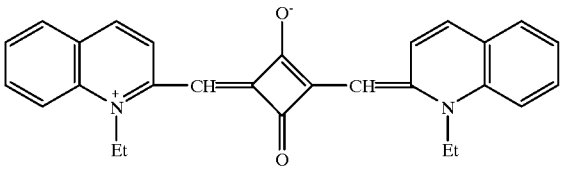
IR41
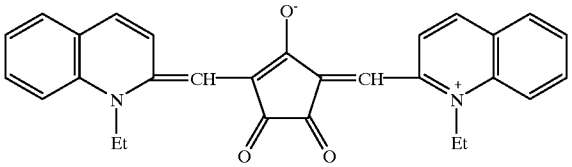
IR42
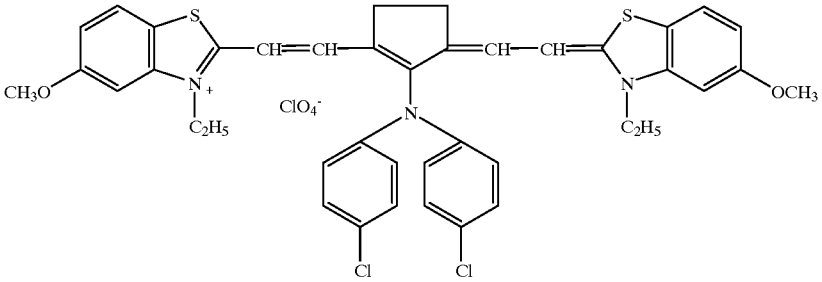

-continued
IR43
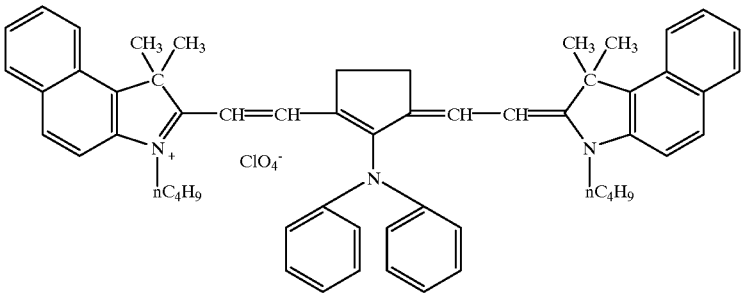
IR44
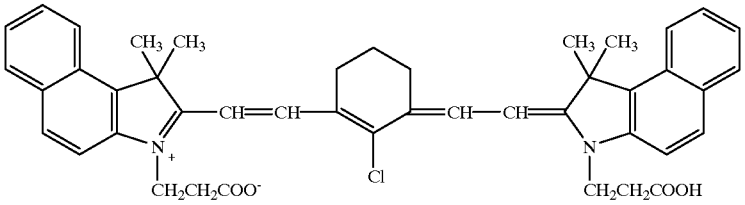
IR45
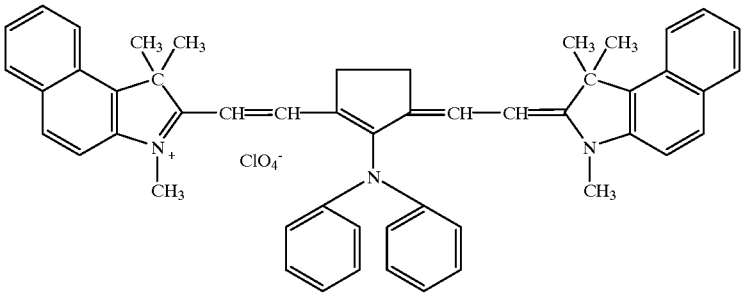
IR46
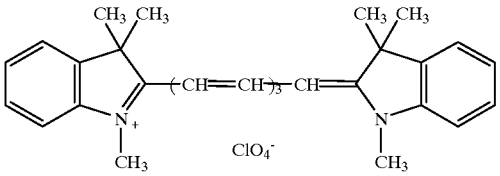
IR47
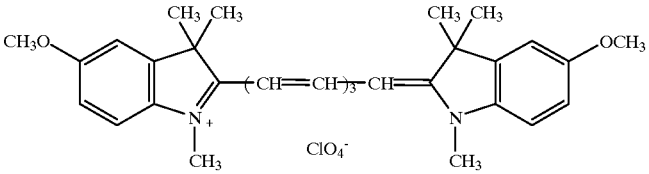
IR48
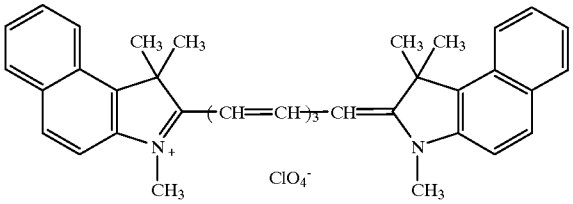

-continued
IR49
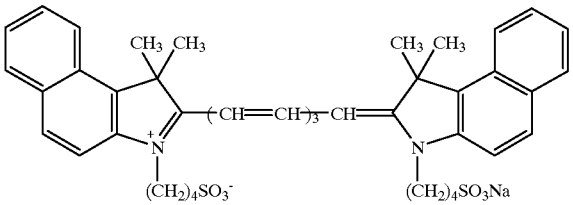
IR50
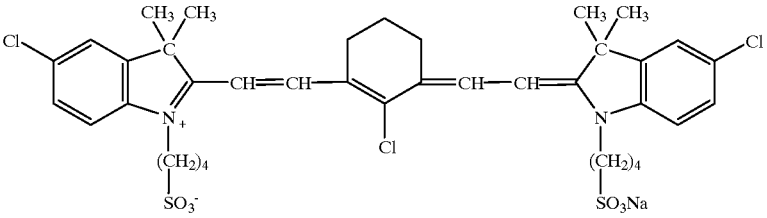
IR51
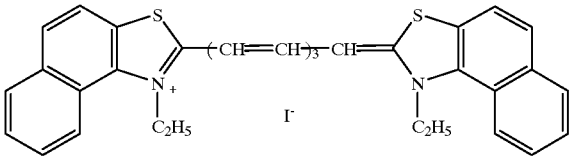
IR52
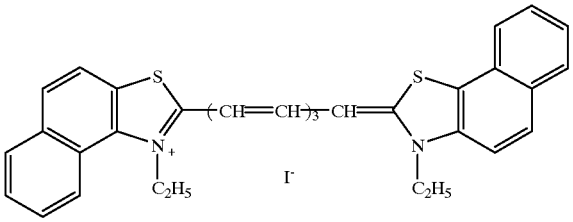
IR53
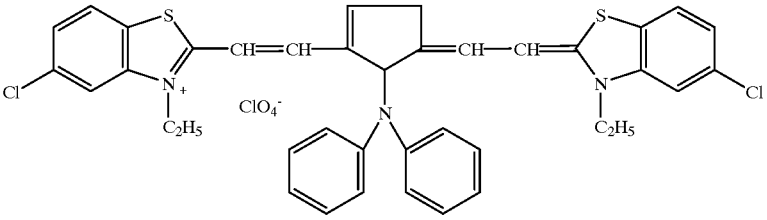
IR54
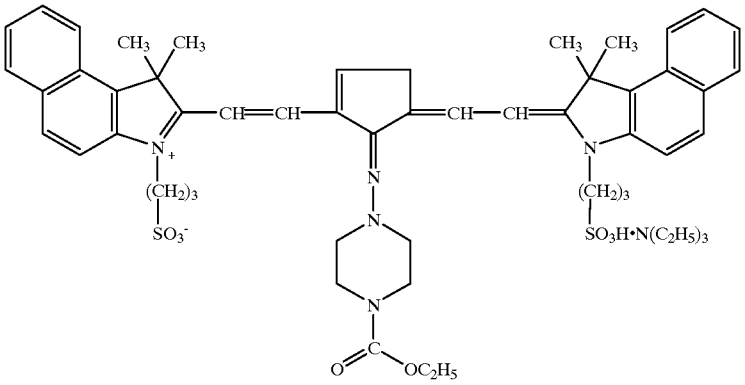

-continued

IR55

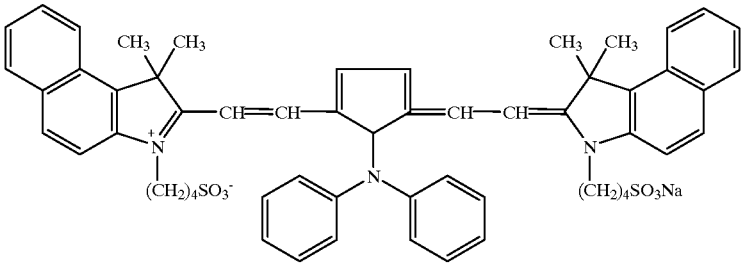

IR56

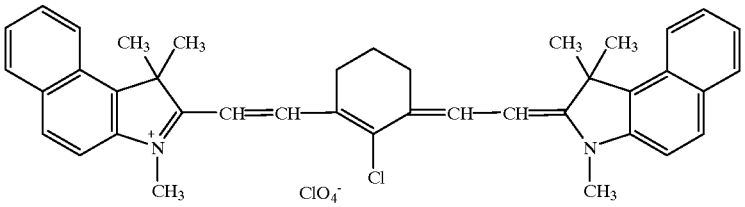

These dyes can be obtained by a conventional synthetic method, and the following commercially available dyes can be used:

IR750 (antraquinone type); IR002 and IR003 (aluminum type), IR820 (polymethine type); IRG022 and IRG033 (diimmonium type); CY-2, CY-4, CY-9 and CY-20, each produced by Nihon Kayaku Co., Ltd.;

KIR103 and SIR103 (phthalocyanine type); KIR101 and SIR114 (antraquinone type); PA1001, PA1005, PA1006 and SIR128, (metal complex type), each produced by Mitsui Toatsu Co., Ltd.;

Fastogen Blue 8120 produced by Dainihon Ink Kagaku Co., Ltd.; and

MIR-101,1011, and 1021 each produced by Midori Kagaku Co., Ltd.

Other infrared dyes are sold by Nihon Kankoshikiso Co., Ltd., Sumitomo Kagaku Co., Ltd. or Fuji Film Co., Ltd.

In the invention, the content of the infrared absorber in the light sensitive composition is preferably 0.5 to 10% by weight based on the total weight of solid components of the light sensitive composition.

(Binder)

The binder used in the light sensitive composition of the invention includes the alkali soluble resin such as the novolak resin, the vinyl polymer having a phenolic hydroxy group, or the polycondensate of polyhydric phenol with aldehyde or ketone as described above.

In the invention, the content of the binder in the light sensitive composition is preferably 20 to 90% by weight, and more preferably 30 to 80% by weight based on the total weight of solid components of the light sensitive composition.

In the invention, a print-out material is used to form a visible image after exposure. The print-out material is composed of a compound capable of producing an acid or free radical on light exposure and an organic dye varying its color on reaction with the free radical or acid. The example of the compound capable of producing an acid or free radical on light exposure includes o-naphthoquinonediazide-4-sulfonic acid halogenide disclosed in Japanese Patent O.P.I. Publication No. 50-36209, a trihalomethylpyrone or trihalomethyltriazine disclosed in Japanese Patent O.P.I. Publication No. 53-36223, an ester compound of o-naphthoquinonediazide-4-sulfonic acid chloride with a phenol having an electron-attractive group or an amide compound of o-naphthoquinonediazide-4-sulfonic acid chloride with aniline disclosed in Japanese Patent O.P.I. Publication No. 55-6244, a halomethylvinyloxadiazole or diazonium salt disclosed in Japanese Patent O.P.I. Publication Nos. 55-77742 and 57-148784. The organic dye includes Victoria Pure Blue BOH (produced by Hodogaya Kagaku Co. Ltd.), Patent Pure Blue (produced by Sumitomomikuni Kagaku Co. Ltd.), Oil Blue #603 (produced by Orient Kagaku Co. Ltd.), Sudan Blue II (produced by BASF), Crystal Violet, Malachite Green, Fuchsin, Methyl Violet, Ethyl Violet, Methyl Orange, Brilliant green, Eosine, Congo Red and Rhodamine 66.

The light sensitive composition in the invention optionally contains a plasticizer, a surfactant, an organic acid or an acid anhydride, besides the above described.

The light sensitive composition in the invention may further contain an lipophilic agent for improving a lipophilicity of image portions such as a p-tert-butylphenol-formaldehyde resin, a p-n-octylphenol-formaldehyde resin or their resins thereof partially esterified with an o-quinonediazide compound.

The light sensitive layer in the invention can be formed by dissolving or dispersing the light sensitive composition in a solvent to obtain a coating solution, coating the solution on a support and then drying the coated support.

The solvent for dissolving the light sensitive composition includes methylcellosolve, methylcellosolve acetate, ethylcellosolve, ethylcellosolve acetate, diethylene glycol monomethylether, diethylene glycol monoethylether, diethylene glycol dimethylether, diethylene glycol methylethylether, diethylene glycol diethylether, diethylene glycol monoisopropylether, propylene glycol, propylene glycol monoethylether acetate, propylene glycol monobutylether, dipropylene glycol monomethylether, dipropylene glycol dimethylether, dipropylene glycol methylethylether, ethyl formate, propyl formate, butyl formate, amyl formate, methyl acetate, ethyl acetate, propyl acetate, butyl acetate, methyl propionate, ethyl propionate, methyl butyrate, ethyl butyrate, dimethylformamide, dimethylsulfoxide, dioxane, acetone, methylethylketone, cyclohexanone, methylcyclohexanone, discetonealcohol, acetylacetone, γ-butyrolactone. These solvents can be used singly or in combination.

The coating method for coating the light sensitive composition on a support includes a conventional coating method such as whirl coating, dip coating, air-knife coating, spray coating, air-spray coating, static air-spray coating, roll coating, blade coating or curtain coating.

The dry coating amount of the light sensitive layer is preferably 0.8 to 1.8 g/m$^2$, and more preferably 1.2 to 1.6 g/m$^2$. The light sensitive layer optionally contains a matting agent.

A protective layer can be provided on the surface of the support opposite the light sensitive layer as disclosed in Japanese Patent O.P.I. Publication Nos. 50-151136, 57-63293, 60-73538, 61-67863 and 6-35174, whereby dissolution of an aluminum support in a developing solution is prevented or the light sensitive layer scratching damage is minimized when presensitized planographic printing plates are stacked.

Similarly, the protective layer can be provided on the light sensitive layer. The protective layer preferably has a high solubility in the developing solution (generally an alkaline solution). The compound used in the protective layer includes polyvinyl alcohol, polyvinyl pyrrolidone, gelatin, casein, gum arabic, and a water soluble amide.

Imagewise exposure is carried out employing an ordinary analogue light source or laser scanning. The various laser can be used in accordance with the spectral sensitivity or sensitivity of the light sensitive layer. The laser for imagewise exposure includes a helium-cadmium laser, an argon ion laser, a helium-neon laser, a semiconductor laser, a YAG laser or a combination of the YAG laser and an optical element in which the wavelength is halved.

EXAMPLES

The invention will further be explained concretely as follows, referring to the examples to which the invention is not limited.

Example 1/Comparative Example 1

A 0.24-mm-thick aluminum web (material 1050, refining H 16) was immersed in a 1% sodium hydroxide aqueous solution kept at 50° C. to give a dissolution amount of aluminum of 2 g/m$^2$, washed with water, immersed for 10 seconds to be neutralized at 25° C. in the same solution as the electrolytic solution in which electrolytic surface-roughening is carried out later, and then was washed with water. Then, the resulting aluminum web was subjected continuously to electrolytic surface-roughening processing by the use of an electrolytic apparatus shown in FIGS. 1, 2 and 3 and an electrolytic solution (of 25° C.) as shown in Table 1 under condition of an arrangement of electrodes and other conditions as shown in Table 1 (an electrolytic apparatus shown in FIGS. 1 through 3 is equipped with 24 electrodes each being capable of being dismounted and having a length in the transport direction of 20 cm).

A distance between the electrode and the surface of the web in this case was kept to be 10 mm. After the electrolytic surface-roughening, the web was dipped in a 1% sodium hydroxide aqueous solution kept at 50° C. to be etched so that the dissolution amount of aluminum is 2 g/m$^2$, then dipped for 10 seconds to be neutralized in a 10% sulfuric acid aqueous solution kept at 25° C., and then was washed with water. After that, the web was subjected to anodization in a 20% sulfuric acid aqueous solution for 30 seconds under the conditions of 25° C. in terms of temperature and of 5 A/dm$^2$ in terms of current density. Thus, a support for a planographic printing plate was obtained.

Uniformity of large pits, an average opening size of large pits, an average opening size of small pits, and a depth to size ratio of small pits of the surface of the support were evaluated or measured through the following methods. The results are shown in Tables 1 and 2.

(Evaluation of Support)

Using an SEM photograph of the support surface, the large pit uniformity was evaluated, and the average opening size of large and small pits, and the depth to size ratio of small pits were measured.

The large pits herein referred to implies dual-structured pits having an opening size exceeding 2 μm and further having additional pits of 2 μm or less in the inner walls, while the small pits herein referred to implies ones having an opening size of 0.1 to 2 μm without additional pits in the inner walls. Pits having an opening size of less than 0.1 μm were ignored.

The 500 power SEM photograph of the support surface was measured, and uniformity of the large pits was evaluated according to good/poor criteria. The average opening size of the large pits was obtained employing a 1,000 power SEM photograph of the support surface as follows: The major and minor axis lengths of the large pits having a clear periphery were measured, and their average was computed to obtain an opening size. Thereafter, the average opening size of the total large pits was computed. The average opening size of the small pits was obtained employing a 5000 power SEM photograph of the support surface, in the same manner as for the large pits. The depth to size ratio of the small pits were measured from the pits whose cross section is obtained by cutting the center of the pits employing a 5000 to 20,000 power SEM photograph of the support surface.

TABLE 1

| Example/ Comparative example | Composition of electrolytic solution used | | Electrode to be used (portions indicated with screen)* | | | | | | | | | | | | | | | | | | | | | | | | Line speed (cm/sec) |
|---|---|---|---|---|---|---|---|---|---|---|---|---|---|---|---|---|---|---|---|---|---|---|---|---|---|---|---|
| | Hydrochloric acid (g/liter) | Acetic acid (g/liter) | a | b | c | d | e | f | g | h | i | j | k | l | m | n | o | p | q | r | s | t | u | v | w | x | |
| Example 1-1 | 10 | 20 | ▒ | ▒ | ▒ | | ▒ | ▒ | ▒ | | ▒ | ▒ | ▒ | | ▒ | ▒ | ▒ | | ▒ | ▒ | ▒ | | ▒ | ▒ | ▒ | | 10 |
| Example 1-2 | 10 | 20 | ▒ | ▒ | | | ▒ | ▒ | | | ▒ | ▒ | | | ▒ | ▒ | | | ▒ | ▒ | | | ▒ | ▒ | | | 10 |
| Example 1-3 | 10 | 20 | ▒ | | ▒ | | ▒ | | ▒ | | ▒ | | ▒ | | ▒ | | ▒ | | ▒ | | ▒ | | ▒ | | ▒ | | 10 |
| Example 1-4 | 10 | 20 | ▒ | ▒ | ▒ | | ▒ | ▒ | ▒ | | ▒ | ▒ | ▒ | | ▒ | ▒ | ▒ | | ▒ | ▒ | ▒ | | ▒ | ▒ | ▒ | | 20 |
| Example 1-5 | 10 | 20 | ▒ | | ▒ | | ▒ | | ▒ | | ▒ | | ▒ | | ▒ | | ▒ | | ▒ | | ▒ | | ▒ | | ▒ | | 15 |
| Comparative example 1-1 | 10 | 20 | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | 10 |
| Comparative example 1-2 | 10 | 20 | ▒ | ▒ | ▒ | ▒ | ▒ | ▒ | | | ▒ | ▒ | ▒ | ▒ | ▒ | ▒ | | | ▒ | ▒ | ▒ | ▒ | ▒ | ▒ | | | 10 |
| Comparative example 1-3 | 10 | 20 | ▒ | ▒ | ▒ | ▒ | | | ▒ | ▒ | ▒ | ▒ | | | ▒ | ▒ | ▒ | ▒ | | | ▒ | ▒ | ▒ | ▒ | | | 10 |
| Comparative example 1-4 | 10 | 0 | ▒ | | ▒ | | ▒ | | ▒ | | ▒ | | ▒ | | ▒ | | ▒ | | ▒ | | ▒ | | ▒ | | ▒ | | 10 |

*Shielding rollers were arranged at places where electrodes were not arranged, as shown in FIG. 3.
The current density was less than 0.1 A/dm$^2$ at the places where electrodes were not arranged.

TABLE 2

| Example/ Comparative example | Current density (average value) (A/dm$^2$) | Quantity of electricity (C/dm$^2$) | Quantity of electricity for processing per 1 step (average value) (C/dm$^2$) | Time period for slow or zero electrolytic processing (average value) (seconds) | Uniformity of large pits | Average opening size of large pits ($\mu$m) | Average opening size of small pits ($\mu$m) | Depth to size ratio of small pits |
|---|---|---|---|---|---|---|---|---|
| Example 1-1 | 43.6 | 500 | 83.3 | 2.4 | good | 4.8 | 0.6 | 0.15 |
| Example 1-2 | 65.4 | 500 | 83.3 | 4.8 | very good | 4.0 | 0.6 | 0.15 |
| Example 1-3 | 65.4 | 500 | 41.7 | 2.4 | very good | 3.5 | 0.6 | 0.15 |
| Example 1-4 | 87.3 | 500 | 83.3 | 1.2 | good | 5.0 | 0.6 | 0.15 |
| Example 1-5 | 98.2 | 500 | 41.7 | 1.8 | very good | 3.6 | 0.6 | 0.15 |
| Comparative example 1-1 | 32.7 | 500 | 500.0 | 0.0 | poor | 11.5 | 0.6 | 0.15 |
| Comparative example 1-2 | 43.6 | 500 | 166.7 | 4.8 | poor | 10.8 | 0.6 | 0.15 |
| Comparative example 1-3 | 49.1 | 500 | 125.0 | 4.8 | poor | 8.0 | 0.6 | 0.15 |
| Comparative example 1-4 | 65.4 | 500 | 41.7 | 2.4 | very good | 3.7 | 0.6 | 0.30 |

Example 2/Comparative Example 2

A 0.24-mm-thick aluminum plate (material 1050, refining H 16), which was not subjected to brush roughening treatment, was immersed in a 1% sodium hydroxide aqueous solution kept at 50° C. to give a dissolution amount of aluminum of 2 g/m$^2$, washed with water, immersed for 10 seconds to be neutralized at 25° C. in the same solution as the electrolytic solution in which electrolytic surface-roughening was carried out later, and then was washed with water. A 0.24-mm-thick aluminum plate (material 1050, refining H 16), as described "yes" in "Brush roughening " column in Table 3, was surface roughened with a cylindrical nylon brush and a 15% alumina (#800) slurry, then immersed in a 1% sodium hydroxide aqueous solution kept at 50° C. to give a dissolution amount of aluminum of 5 g/m$^2$, washed with water, immersed for 10 seconds to be neutralized at 25° C. in the same solution as the electrolytic solution in which electrolytic surface-roughening was carried out later, and then was washed with water.

The resulting aluminum plate was subjected to electrolytic surface-roughening processing by the use of an electrolytic apparatus of a batch type and an electrolytic solution (of 25° C.) as shown in Table 3 under conditions as shown in Table 3. A distance between the electrode and the surface of the plate in this case was kept to be 10 mm. After the electrolytic surface-roughening, the plate was dipped in a 1% sodium hydroxide aqueous solution kept at 50° C. to be etched so that the dissolution amount of aluminum is 2.0 g/m$^2$, then dipped to be neutralized for 10 seconds in a 10% sulfuric acid aqueous solution kept at 25° C., and then was washed with water. After that, the plate was subjected to anodization in a 20% sulfuric acid aqueous solution for 30 seconds under the conditions of 25° C. in terms of temperature and of 5 A/dm$^2$ in terms of current density. Thus, a support for a planographic printing plate was obtained.

Uniformity of large pits, an average opening size of large pits, an average opening size of small pits, and a depth to size ratio of small pits of the surface of the support were evaluated or measured through the above described methods. The results are shown in Tables 3 and 4.

TABLE 3

| Example/ Comparative example | Brush rough-ening | Composition of electrolytic solution used: Hydro-chloric acid (g/liter) | Acetic acid (g/liter) | Nitric acid (g/liter) | Current density (average value) at electrolytical surface-roughening ($A/dm^2$) | Quantity of electricity for electrolytic processing per 1 step (average value) ($C/dm^2$) | Frequency of electrolytic processing (times) |
|---|---|---|---|---|---|---|---|
| Example 2-1 | No | 10 | 20 | 0 | 50 | 80 | 6 |
| Example 2-2 | No | 10 | 10 | 0 | 50 | 80 | 6 |
| Example 2-3 | No | 10 | 20 | 0 | 50 | 40 | 12 |
| Example 2-4 | No | 10 | 20 | 0 | 50 | 40 | 12 |
| Example 2-5 | No | 10 | 20 | 0 | 50 | 40 | 12 |
| Example 2-6 | No | 10 | 30 | 0 | 50 | 40 | 12 |
| Example 2-7 | No | 10 | 20 | 0 | 25 | 80 | 6 |
| Example 2-8 | No | 10 | 20 | 0 | 75 | 80 | 6 |
| Example 2-9 | No | 10 | 20 | 0 | 25 | 40 | 12 |
| Example 2-10 | No | 10 | 30 | 0 | 75 | 40 | 12 |
| Example 2-11 | Yes | 10 | 20 | 0 | 50 | 200 | 1 |
| Example 2-12 | Yes | 10 | 20 | 0 | 50 | 50 | 4 |
| Comparative example 2-1 | No | 10 | 20 | 0 | 50 | 500 | 1 |
| Comparative example 2-2 | No | 10 | 20 | 0 | 25 | 500 | 1 |
| Comparative example 2-3 | No | 10 | 20 | 0 | 50 | 200 | 3 |
| Comparative example 2-4 | No | 10 | 20 | 0 | 50 | 125 | 4 |
| Comparative example 2-5 | No | 10 | 20 | 0 | 50 | 125 | 4 |
| Comprative example 2-6 | No | 10 | 0 | 0 | 50 | 80 | 6 |
| Comparative example 2-7 | No | 0 | 0 | 15 | 50 | 500 | 1 |
| Comparative example 2-8 | Yes | 0 | 0 | 15 | 50 | 200 | 1 |

TABLE 4

| Example/ Comparative example | Quantity of electricity (Total) ($C/dm^2$) | Current density during period for slow or zero electrolytic processing ($A/dm^2$) | Time period for slow or zero electrolytic processing (seconds) | Uniformity of large pits | Average opening size of large pits ($\mu m$) | Average opening size of small pits ($\mu m$) | Depth to size ratio of small pits (—) |
|---|---|---|---|---|---|---|---|
| Example 2-1 | 480 | 1 | 1.0 | good | 5.2 | 0.6 | 0.15 |
| Example 2-2 | 480 | 0 | 3.0 | good | 4.8 | 0.6 | 0.20 |
| Example 2-3 | 480 | 0 | 0.7 | good | 5.0 | 0.6 | 0.15 |
| Example 2-4 | 480 | 0 | 1.0 | very good | 3.8 | 0.6 | 0.15 |
| Example 2-5 | 480 | 0 | 4.0 | very good | 3.5 | 0.6 | 0.15 |
| Example 2-6 | 480 | 0 | 4.0 | very good | 3.5 | 0.6 | 0.13 |
| Example 2-7 | 480 | 0 | 4.0 | good | 5.0 | 0.6 | 0.15 |
| Example 2-8 | 480 | 2 | 2.0 | good | 5.3 | 0.6 | 0.15 |
| Example 2-9 | 480 | 1 | 3.0 | very good | 3.5 | 0.6 | 0.15 |
| Example 2-10 | 480 | 0 | 2.0 | very good | 3.4 | 0.6 | 0.12 |
| Example 2-11 | 200 | — | — | very good | 8.0 | 0.8 | 0.20 |
| Example 2-12 | 200 | 0 | 2.0 | very good | 8.0 | 0.6 | 0.15 |
| Comparative example 2-1 | 500 | — | — | poor | 13.3 | 0.6 | 0.15 |
| Comparative example 2-2 | 500 | — | — | poor | 12.4 | 0.6 | 0.15 |
| Comparative example 2-3 | 600 | 0 | 1.0 | poor | 12.2 | 0.6 | 0.15 |
| Comparative example 2-4 | 500 | 0 | 2.0 | poor | 11.6 | 0.6 | 0.15 |
| Comparative example 2-5 | 500 | 0 | 3.0 | poor | 9.2 | 0.6 | 0.15 |
| Comparative example 2-6 | 480 | 0 | 1.0 | good | 5.8 | 0.6 | 0.30 |
| Comparative | 500 | — | — | no apparent large | | 1.8 | 0.39 |

TABLE 4-continued

| Example/ Comparative example | Quantity of electricity (Total) (C/dm$^2$) | Current density during period for slow or zero electrolytic processing (A/dm$^2$) | Time period for slow or zero electrolytic processing (seconds) | Uniformity of large pits | Average opening size of large pits (μm) | Average opening size of small pits (μm) | Depth to size ratio of small pits (—) |
|---|---|---|---|---|---|---|---|
| example 2-7 | | | | pits | | | |
| Comparative example 2-8 | 200 | — | — | very good | 8.0 | 1.5 | 0.40 |

Example 3/Comparative Example 3

As shown in Table 5, electrolytic surface-roughening was carried out under the same condition as in Example 1/Comparative example 1 or in Example 2/Comparative example 2. After the electrolytic surface-roughening, the resulting web or plate was dipped in a 1% sodium hydroxide aqueous solution kept at 50° C. to be etched so that the dissolution amount of aluminum was as shown in Table 5, then dipped for 10 seconds to be neutralized in a 10% sulfuric acid aqueous solution kept at 25° C., and then was washed with water. After that, the web or plate was subjected to anodization in a 20% sulfuric acid aqueous solution for 30 minutes in terms of 5 A/dm$^2$ in terms of current density. Then, the web or plate was dipped for 10 seconds in a 0.1% ammonium acetate aqueous solution kept at 90° C. to carry out sealing processing, then was dried at 80° C. for 5 minutes, thus each support for a planographic printing plate was obtained. Uniformity of large pits, an average opening size of small pits, and a depth to size ratio of small pits of the surface of the support are shown in Table 5.

(Preparation of Presensitized Planographic Printing Plate)

Next, a coating solution of the following light sensitive composition was coated on each support for a planographic printing plate by the use of a wire bar, and dried at 80° C. to obtain a light sensitive layer, thus a presensitized planographic printing plate was obtained. The dry coating amount of the light sensitive layer was 1.6 g/m$^2$.

| Positive Working Light Sensitive Layer | |
|---|---|
| Novolak resin (phenol/m-cresol/p-cresol, 10/54/36, mol ratio), Mw: 4,000) | 6.70 g |
| Condensation product (esterification rate: 30%) of a pyrogallol-acetone resin (Mw: 3,000) with o-naphthoquinone diazide-5-sulfonylchloride | 1.50 g |
| Polyethylene glycol #2,000 | 0.20 g |
| Victoria Pure Blue BOH (made by Hodogaya Kagaku Co., Ltd.) | 0.08 g |
| 2,4-Bis(trichloromethyl)-6-(p-methoxystyryl)-s-tyriazine | 0.15 g |
| FC-430 (made by Sumitom 3M Co., Ltd.) | 0.03 g |
| Cis-1,2-Cyclohexanedicarboxylic acid | 0.02 g |
| Methyl cellosolve | 100 ml |

(Preparation of Planographic Printing Plate)

The presensitized planographic printing plate obtained above was exposed at 8 mw/cm$^2$ for 60 seconds employing a 4 kw metal halide lamp. The exposed plate was then developed at 27° C. for 20 seconds employing a developer obtained by diluting with water by 6 factors (by volume) a commercially available developer SDR-1 (made by Konica Corporation) to obtain a positive-working planographic printing plate. The resulting printing plate was evaluated according to the following method.

Evaluation of Printing Property (Evaluation of Dot Gain at High Fineness)

Employing the printing plate obtained above, printing was carried out on a printing machine (DAIYA1F-1 produced by Mitsubishi Jukogyo Co., Ltd.), wherein a coated paper, dampening water (Etch Solution SG-51 (Concentration 1.5%) produced by Tokyo Ink Co., Ltd.) and printing ink (Hyplus M magenta produced by Toyo Ink Manufacturing Co., Ltd.) were used. Printing was carried out to give an image density of 1.6, and the dot on the printing matter at 50% dot area at a screen line number of 600 line/inch was measured for dot gain. Measurement was carried out using a Macbeth densitometer.

(Evaluation of Stain on Blanket)

Printing was carried out in the same printing conditions as above. After five thousand sheets of coated paper was printed, stain on the blanket (on blanket portions corresponding to non-image portions on the printing plate) was evaluated. The cello tape was adhered to, and peeled from the blanket, and the peeled cello tape was adhered to a white paper. The cellophane tape on the paper was visually observed, and stain was evaluated according to good/poor criteria.

(Evaluation of anti-staining property at less dampening water supplying)

The printing plate obtained above was mounted on a printing machine (DAIYA1F-1 produced by Mitsubishi Jukogyo Co., Ltd.), and printing was carried out in the same manner as above, ecept that the dampening water supply is gradually decreased. Anti-staining property at less dampening water supplying was measured and evaluated according to good/poor criteria.

(Evaluation of Printing Property)

Printing was carried out employing printing paper with poor ink absorption. Printing was carried out in the same manner as above, except that YUPO paper was used instead of coated paper, and printing property was evaluated according to good/poor criteria.

TABLE 5

| Example/ Comparative example | Surface-roughening method for support | Dissolution amount of aluminum after electrolysis ($g/m^2$) | Uniformity of large pits | Average opening size of small pits ($\mu m$) | Depth to size ratio of small pits (—) | Dot gain 600 lines (%) | Stain of blanket | Anti-staining property at less dampening water supplying | Printing property in employing paper with poor water absorption |
|---|---|---|---|---|---|---|---|---|---|
| Example 3-1 | Example 1-3 | 2.0 | very good | 0.6 | 0.15 | 14 | very good | | |
| Example 3-2 | Example 1-3 | 1.0 | good | 0.5 | 0.18 | 15 | good | | |
| Example 3-3 | Example 2-2 | 1.5 | good | 0.6 | 0.20 | 17 | good | good | good |
| Example 3-4 | Example 2-2 | 2.5 | very good | 0.7 | 0.15 | 18 | very good | good | good |
| Example 3-5 | Example 2-6 | 2.0 | very good | 0.6 | 0.13 | 14 | very good | very good | very good |
| Example 3-6 | Example 2-6 | 1.5 | very good | 0.6 | 0.15 | 14 | very good | very good | very good |
| Example 3-7 | Example 2-9 | 1.0 | very good | 0.5 | 0.19 | i5 | good | good | good |
| Example 3-8 | Example 2-9 | 2.0 | very good | 0.6 | 0.15 | 14 | very good | very good | very good |
| Example 3-9 | Example 2-12 | 1.5 | very good | 0.6 | 0.15 | 19 | very good | very good | very good |
| Example 3-10 | Example 2-12 | 2.0 | very good | 0.6 | 0.15 | 19 | very good | very good | very good |
| Comparative example 3-1 | Comarative example 1-3 | 2.0 | poor | 0.6 | 0.15 | 23 | good | slightly poor | slightly poor |
| Comparative example 3-2 | Comparative example 2-4 | 1.0 | poor | 0.5 | 0.18 | 27 | good | poor | poor |
| Comparative example 3-3 | Comparative example 2-6 | 3.0 | good | 1.0 | 0.25 | 20 | slightly poor | slightly poor | slightly poor |
| Comparative example 3-4 | Comparative example 2-7 | 2.0 | No apparent large pits | 1.8 | 0.39 | 18 | very poor | very poor | very poor |
| Comparative example 3-5 | Comparative example 2-8 | 3.0 | very good | 2.5 | 0.35 | 19 | poor | poor | poor |

As is apparent from Table 5, the inventive samples 3-1 through 3-10 provide superior results in dot gain, stain of blanket, anti-staining property at less dampening water supplying, and printing property in employing paper with poor water absorption, as compared to comparative samples 3-1 through 3-5 outside the invention.

What is claimed is:

1. A method for manufacturing a presensitized planographic printing plate comprising a support, and provided thereon, a light sensitive layer, the support having small pits with an average opening size of 0.2 to 0.8 $\mu m$ and a depth to size ratio of 0.2 or less, and large pits, the method comprising the steps of:

(a) chemically graining the surface of an aluminum or its alloy;

(b) electrolytically surface roughening the resulting aluminum or alloy in an acidic electrolyte solution;

(c) chemically surface roughening the electrolytically surface roughened aluminum or alloy by dissolving with an alkali 0.6 to 3.0 $g/m^2$ of the aluminum or alloy;

(d) anodizing the chemically surface roughened aluminum or alloy; and (e) providing a light sensitive layer on the anodized aluminum or alloys, wherein the electrolytically surface roughening step comprises plural pairs of a first high processing rate step and a second low or zero processing rate step, the first step and the second step being carried out alternately, and the first step electrolytically surface roughens the chemically grained aluminum or alloy in an average guantity of electricity of not greater than 100 $C/dm^2$.

2. The method of claim 1, wherein the large pits have an average opening size of 3 to 6 $\mu m$.

3. The method of claim 1, wherein the step (a) comprises the step of chemically graining the surface of the aluminum or alloy by dissolving with an alkali 3.0 to 10.0 $g/m^2$ of the aluminum or alloy.

4. The method of claim 1, wherein said acidic electrolyte solution contains hydrochloric acid and acetic acid.

5. The method of claim 4, wherein said acidic electrolyte solution contains 7 to 15 g/liter of hydrochloric acid and 10 to 40 g/liter of acetic acid.

6. The method of claim 1, wherein said acidic electrolyte solution contains 7 to 15 g/liter of hydrochloric acid and 10 to 40 giliter of acetic acid.

7. The method of claim 1, wherein the low or zero processing rate step is carried out in 0.6 to 5 seconds.

8. The method of claim 1, wherein neutralizing is conducted between steps (a) and (b) and between steps (c) and (d) employing an acid solution containing hydrochloride or acetic acid.

9. The method of claim 1, wherein sealing treatment and/or hydrophilicity providing treatment is conducted between steps (d) and (e).

10. The method of claim 1, wherein said light sensitive layer has a dry thickness of 0.8 to 1.8 $g/m^2$.

11. The method of claim 1, wherein the light sensitive layer contains an o-quinonediazide compound.

12. The method of claim 1 wherein the first step electrolytically surface-roughening is carried out in an average quantity of electricity of 40 to 83.3 $C/dm^2$.

13. The method of claim 12, wherein the total quantity of electricity is 200 to 1000 $C/dm^2$ through the electrolytically surface-roughening.

14. The method of claim 1, wherein the total quantity of electricity is 100 to 2000 $C/dm^2$ through the electrolytically surface-roughening.

* * * * *